US012228323B2

(12) United States Patent
Kim et al.

(10) Patent No.: US 12,228,323 B2
(45) Date of Patent: Feb. 18, 2025

(54) ICE MAKER AND REFRIGERATOR

(71) Applicant: LG Electronics Inc., Seoul (KR)

(72) Inventors: Yonghyun Kim, Seoul (KR); Jinil Hong, Seoul (KR); Jungjae Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 409 days.

(21) Appl. No.: 17/620,922

(22) PCT Filed: Jun. 19, 2020

(86) PCT No.: PCT/KR2020/007977
§ 371 (c)(1),
(2) Date: Dec. 20, 2021

(87) PCT Pub. No.: WO2020/256474
PCT Pub. Date: Dec. 24, 2020

(65) Prior Publication Data

US 2022/0349638 A1 Nov. 3, 2022

(30) Foreign Application Priority Data

Jun. 19, 2019 (KR) ..... 10-2019-0073162

(51) Int. Cl.
*F25C 1/04* (2018.01)

(52) U.S. Cl.
CPC ..... *F25C 1/04* (2013.01)

(58) Field of Classification Search
CPC ..... F25C 1/04
See application file for complete search history.

(56) References Cited

U.S. PATENT DOCUMENTS 5,056,321 A * 10/1991 Patrick ..... F25C 1/04 62/73
5,400,605 A 3/1995 Jeong
(Continued)

FOREIGN PATENT DOCUMENTS

JP 10047825 2/1998
KR 19950025378 9/1995
(Continued)

OTHER PUBLICATIONS

Notice of Allowance in Korean Appln. No. 10-2019-0073162, mailed on Dec. 6, 2024, 13 pages (with English translation).

*Primary Examiner* — Filip Zec
(74) *Attorney, Agent, or Firm* — Fish & Richardson P.C.

(57) ABSTRACT

A method controls a refrigerator including first and second trays defining an ice chamber, a driving unit for moving the second tray, an ice bin for storing ice produced in the ice chamber, and an ice-fullness detection means for detecting whether or not the ice bin is full of ice. The method includes supplying water to the ice chamber when the second tray is at a water-supply position, making ice after the second tray has moved to an ice-making position in an inverse direction after the water supply has been completed, determining whether the ice bin is full of ice after the ice making is completed, moving the second tray to an ice-separating position and then rotating in the inverse direction if it is not determined whether or not the ice bin is full of ice, and determining again whether the ice bin is full of ice after ice separation is completed.

15 Claims, 27 Drawing Sheets

(56) References Cited

U.S. PATENT DOCUMENTS

| | | | | |
|---|---|---|---|---|
| 8,245,527 | B2 * | 8/2012 | Ducharme | F25C 5/08 62/340 |
| 8,616,013 | B2 * | 12/2013 | Kim | F25C 5/187 62/223 |
| 9,234,688 | B2 * | 1/2016 | Son | F25C 5/06 |
| 9,581,372 | B2 * | 2/2017 | Lee | F25C 5/08 |
| 11,105,547 | B2 * | 8/2021 | Song | F25D 17/065 |
| 11,231,217 | B2 * | 1/2022 | Mitchell | F25C 5/06 |
| 11,709,008 | B2 * | 7/2023 | Naik | F25C 5/08 62/136 |
| 2009/0255279 | A1 | 10/2009 | Kim et al. | |
| 2010/0037631 | A1 * | 2/2010 | Choi | F25C 5/24 62/344 |
| 2013/0081412 | A1 | 4/2013 | Son et al. | |
| 2014/0165643 | A1 * | 6/2014 | Boarman | F25B 21/02 62/340 |
| 2014/0182325 | A1 | 7/2014 | Lee et al. | |
| 2016/0131408 | A1 | 5/2016 | Bertolini et al. | |
| 2018/0164016 | A1 * | 6/2018 | Oh | F25B 49/005 |
| 2020/0400359 | A1 * | 12/2020 | Junge | F25C 5/14 |
| 2021/0080165 | A1 * | 3/2021 | Bertolini | F25C 5/187 |
| 2021/0325100 | A1 * | 10/2021 | Smith | F25C 1/04 |

FOREIGN PATENT DOCUMENTS

| | | |
|---|---|---|
| KR | 20110098091 | 9/2011 |
| KR | 101182276 | 9/2012 |
| KR | 10-2013-0009521 A | 1/2013 |
| KR | 20140088321 | 7/2014 |
| KR | 101456572 | 10/2014 |
| KR | 101850918 | 5/2018 |
| WO | WO 2016/077407 A2 | 5/2016 |

* cited by examiner

ICE MAKER AND REFRIGERATOR

CROSS-REFERENCE TO RELATED APPLICATIONS

This application is a National Stage application under 35 U.S.C. § 371 of International Application No. PCT/KR2020/007977, filed on Jun. 19, 2020, which claims the benefit of Korean Patent Application No. 10-2019-0073162, filed on Jun. 19, 2019. The disclosures of the prior applications are incorporated by reference in their entirety.

TECHNICAL FIELD

The present disclosure relates to an ice maker and a refrigerator.

BACKGROUND ART

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is accommodated in a tray to make ice.

Also, the ice maker is constructed to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

Prior art document 1, Korean Patent No. 10-1850918 provides an ice maker.

The ice maker of prior art document 1 includes an upper tray on which a plurality of hemispherical upper cells are arranged and which includes a pair of link guide parts extending upward from both side ends, an lower tray on which a plurality of hemispherical lower cells are arranged and which is rotatably connected to the upper tray, a rotation shaft which is connected to the rear ends of the lower tray and the upper tray to rotate the lower tray with respect to the upper tray, a pair of links having one end connected to the lower tray, and the other end connected to the link guide part, and an upper ejecting pin assembly each connected to the pair of links in a state where both end portions are fitted in the link guide part, and ascending and descending together with the links.

In the case of prior art document 1, when ice making is completed, the lower tray is rotated to perform ice separation. However, a method for controlling the lower tray in a case where ice fullness is detected in a process of the ice separation is not disclosed.

In Korean Patent Publication No. 10-2011-0098091 (hereinafter referred to as "prior art document 2"), which is a prior art document, a refrigerator and a method for controlling same are disclosed.

The refrigerator of prior art document 2 includes a storage compartment in which a storage space is formed; a door for opening and closing the storage compartment; an ice making compartment provided in the storage chamber or the door; an ice tray rotatably provided in the ice making compartment to be capable of rotating in the forward and reverse directions and in which ice is generated, a driving unit for controlling rotation of the ice tray; an ice storage part provided under the ice tray and storing ice separated from the ice tray; and a sensor part detecting whether the ice stored in the ice storage part has reached a height corresponding to ice fullness.

When ice fullness is detected by the sensor part, the driving unit may rotate the ice tray in the forward direction to perform additional ice separation and then rotate the ice tray in the reverse direction to maintain the ice tray at a preset angle.

In the case of prior art document 2, ice can be separated even when ice fullness is detected after completion of ice making, but this is possible because the distance between the ice tray and the ice fullness height of the ice bank is large, and as in prior art document 1, in the case of a type in which the lower tray is rotated in order to perform the ice separation, there is a disadvantage that it is difficult to apply thereto.

DISCLOSURE

Technical Problem

The present embodiment provides a refrigerator and a method for controlling the same for preventing ice making from starting in a state of the ice fullness of the ice bin.

The present embodiment provides a refrigerator in which ice that is not separated from the ice chamber can be separated from the ice chamber in the process of detecting that the ice bin is full of ice again after the ice separation is completed, and a method for controlling the same.

The present embodiment provides a refrigerator in which a lower tray waits at a water supply position so that ice fullness detection is facilitated again later in a case where ice fullness is detected by ice dropped in the ice separation process after completion of ice separation, and a method for controlling the same.

Technical Solution

A refrigerator according to an aspect may include a storage space configured to store food; a first tray configured to form a portion of an ice chamber for generating ice by cold air for cooling the storage space; a second tray configured to form another portion of the ice chamber and to be rotatable relative to the first tray; a driving unit configured to be operated to rotate the second tray; an ice bin configured to store ice dropped from the ice chamber; an ice fullness detection device configured to detect ice fullness of the ice bin; and a controller configured to control the driving unit.

The controller may control the driving unit to move the second tray to the ice making position after water supply to the ice chamber is completed at the water supply position of the second tray to make ice in the ice chamber.

The controller may control the driving unit to rotate the second tray from the ice making position toward the ice separation position in a forward direction after the generation of ice in the ice chamber is completed.

After completion of ice making, if ice fullness of the ice bin is not detected by the ice fullness detection device, the controller may control the second tray to rotate in the reverse direction after moving from the ice making position to the ice separation position and then may determine again whether the ice fullness of the ice bin is detected by the ice fullness detection device.

The controller may control the driving unit so that the second tray is moved to the water supply position by reverse rotation after the second tray is moved from the ice making position to the ice separation position.

The ice fullness detection device may detect the ice fullness of the ice bin in a process in which the second tray moves to the ice separation position.

As a result of determining again whether the ice fullness of the ice bin is detected, if the ice fullness of the ice bin is not detected, the controller may rotate the second tray to the water supply position by reverse rotation and then start water supply.

The controller may control the driving unit to rotate the second tray to the ice separation position before the second tray is rotated to the water supply position.

As a result of determining again whether the ice fullness of the ice bin is detected, if the ice fullness of the ice bin is detected, the controller may rotate the second tray in a reverse direction to move the second tray to the water supply position and then determine again whether the ice fullness of the ice bin is detected by the ice fullness detection device.

The ice fullness detection device may include an ice fullness detection lever that moves in the same direction as the second tray when the second tray moves from the ice making position to the ice fullness detection position.

The present disclosure according to another aspect relates to a method for controlling a refrigerator including a first tray configured to form a portion of an ice chamber, a second tray configured to form another portion of the ice chamber, a driving unit configured to move the second tray, an ice bin configured to store ice generated in the ice chamber, and an ice-fullness detection device configured to detect whether the ice fullness of the ice bin.

The method for controlling a refrigerator includes performing water supply to the ice chamber in a state where the second tray is moved to a water supply position, performing ice making after the second tray is moved from the water supply position to the ice making position in a reverse direction after the water supply is completed, determining whether the ice fullness of the ice bin after completion of ice making, rotating the second tray in a reverse direction after the second tray is moved to an ice separation position if the ice fullness is not detected in the ice fullness of the ice bin; and determining again whether the ice fullness of the ice bin after the ice separation is completed.

After the completion of the ice making, in the determining whether the ice fullness of the ice bin, the second tray may be rotated from the ice making position toward the ice separation position in a forward direction.

The ice fullness detection device may be configured to detect whether the ice fullness of the ice bin when the second tray is positioned at an ice fullness detection position between the water supply position and the ice separation position.

In the rotating the second tray in the reverse direction after the second tray is moved to the ice separation position, the second tray may be rotated to the water supply position.

The second tray may be rotated toward the ice separation position in a forward direction after waiting for a first set time at the water supply position.

The method for controlling a refrigerator may further include, when the ice fullness of the ice bin is not detected as a result of determining again whether the ice fullness of the ice bin, rotating the second tray to the water supply position, and supplying water to the second tray.

After determining again whether the ice fullness of the ice bin, the second tray may move to the ice separation position before the second tray is rotated to the water supply position.

The method for controlling a refrigerator may further include, when the ice fullness of the ice bin is not detected as a result of determining again whether the ice fullness of the ice bin, rotating the second tray to the water supply position, the second tray waiting for a second set time at the water supply position, and rotating the second tray toward the ice separation position in a forward direction.

Advantageous Effect

According to the proposed embodiment, since ice fullness of the ice bin is not detected during the ice separation process after ice separation is completed, the ice fullness of the ice bin is detected again after performing ice separation, and when ice fullness of the ice bin is detected, the ice making waits until the ice fullness of the ice bin is not detected.

Therefore, when ice fullness is detected after the ice separation is completed, since the ice chamber waits in a state where no ice is present therein, it is possible to prevent in advance the phenomenon in which the ice in the ice chamber melts and is dropped into the ice bin due to an abnormal situation such as a power outage or power supply cutoff or the melted ice freezes again and the opaque or non-spherical ice is dropped into the ice bin.

According to the present embodiment, the lower tray is moved to the ice separation position even if ice fullness of the ice bin is not detected in the process of detecting again the ice fullness of the ice bin, so that even if ice is not separated from the lower tray in the previous ice separation process, finally, there is an advantage that the ice can be separated from the lower tray.

According to this embodiment, since the ice bin waits at the water supply position before the ice fullness of the ice bin is detected again, there is an advantage that freezing between the upper tray and the lower tray is minimized during the waiting process so that the lower tray can be rotated smoothly in the forward direction.

MODE FOR INVENTION

Figure 1:
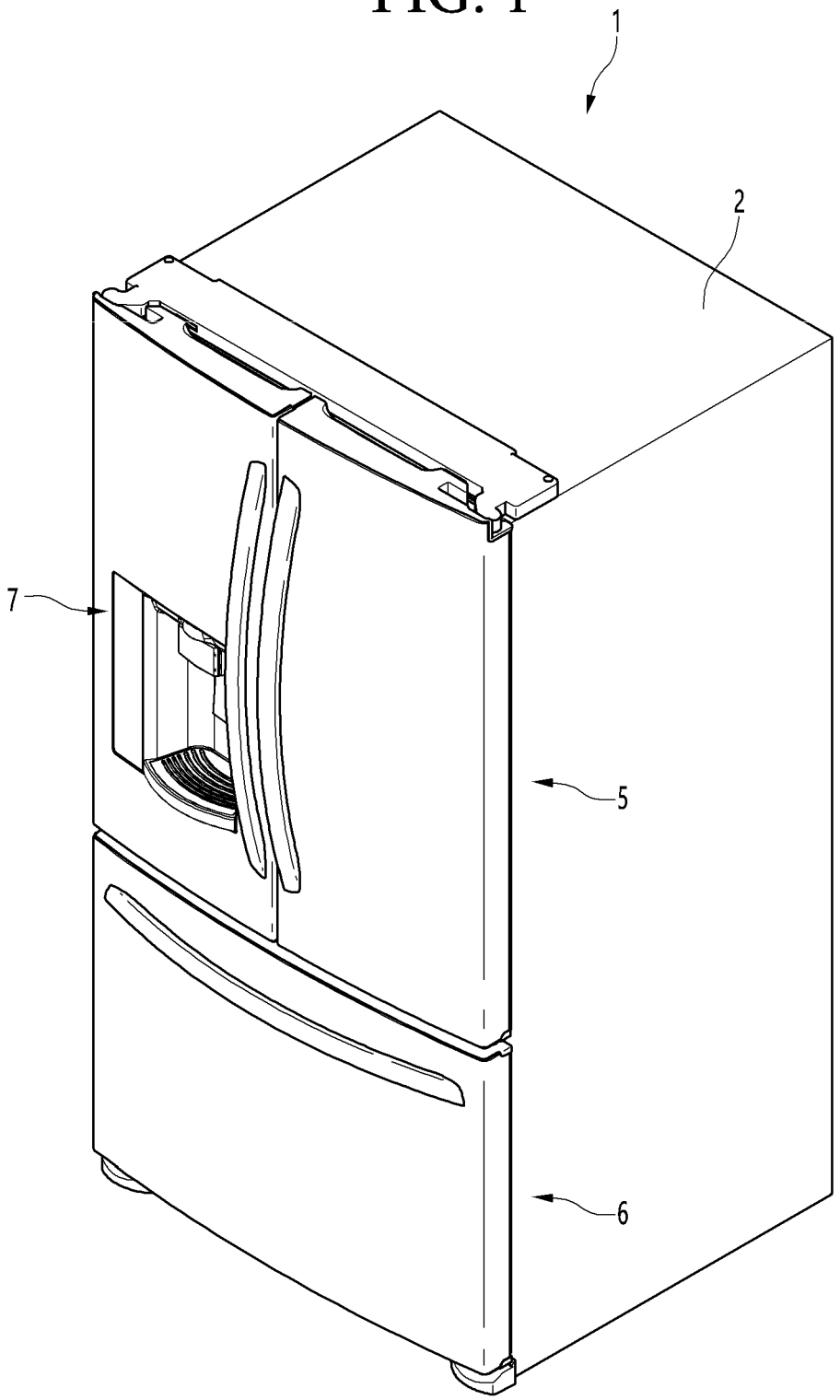
FIG. 1 is a perspective view of a refrigerator according to one embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
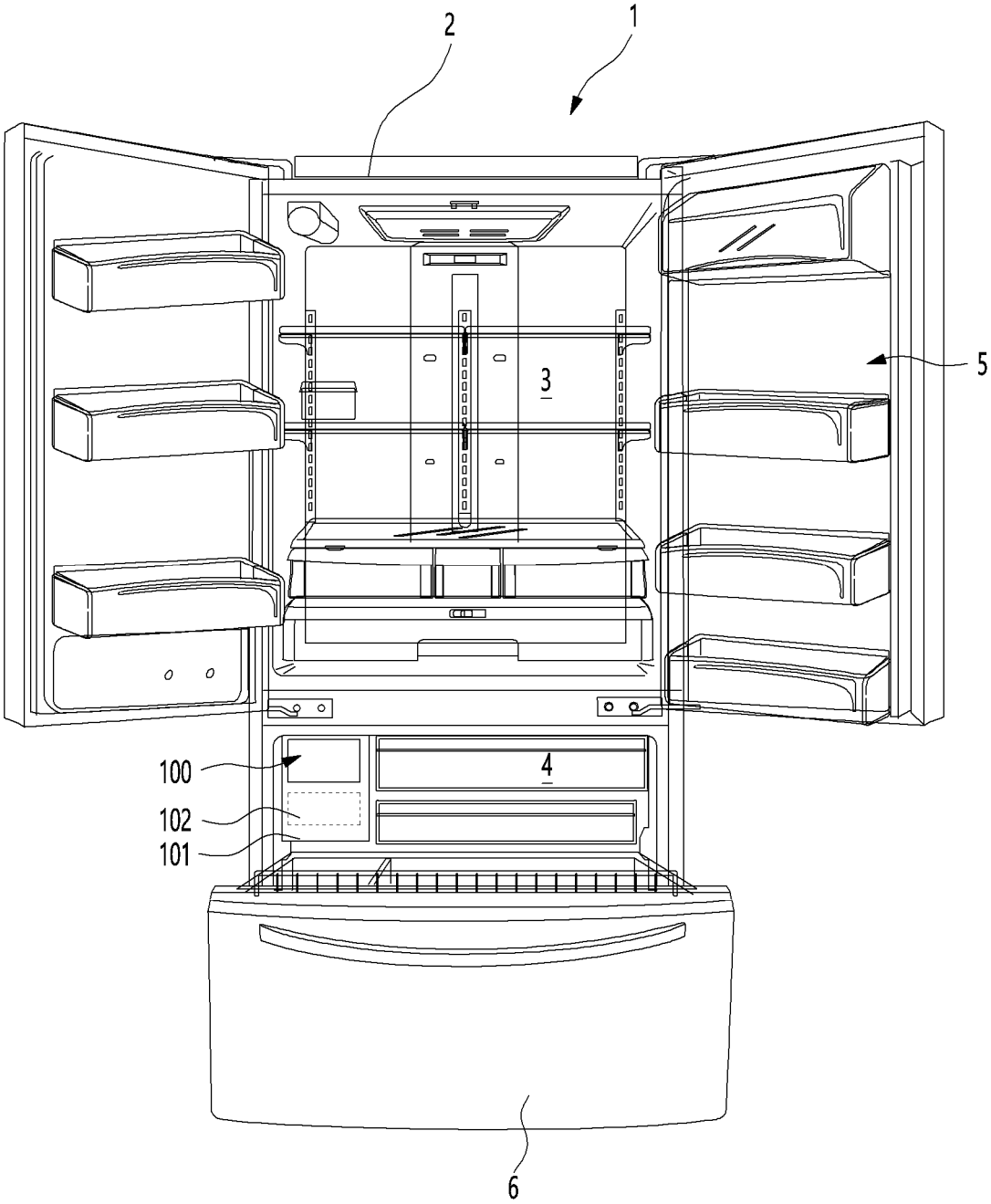
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

For example, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the ice is stored after being transferred from the ice maker 100 may be further provided below the ice maker 100.

The ice maker 100 and the ice bin 102 may be mounted in the freezing compartment 4 in a state of being respectively mounted in separate housings 101.

A duct (not shown) is provided in the freezing compartment 4 to supply cold air to the freezing compartment 4. The cold air discharged from the duct flows to the freezing compartment 4 after flowing through the ice maker 100.

A user may open the refrigerating compartment door 6 to approach the ice bin 102, thereby obtaining the ice. In another example, a dispenser 7 for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser 7 by a transfer unit. Thus, the user may obtain the ice from the dispenser 7.

Hereinafter, the ice maker will be described in detail with reference to the accompanying drawings.

Figure 3:
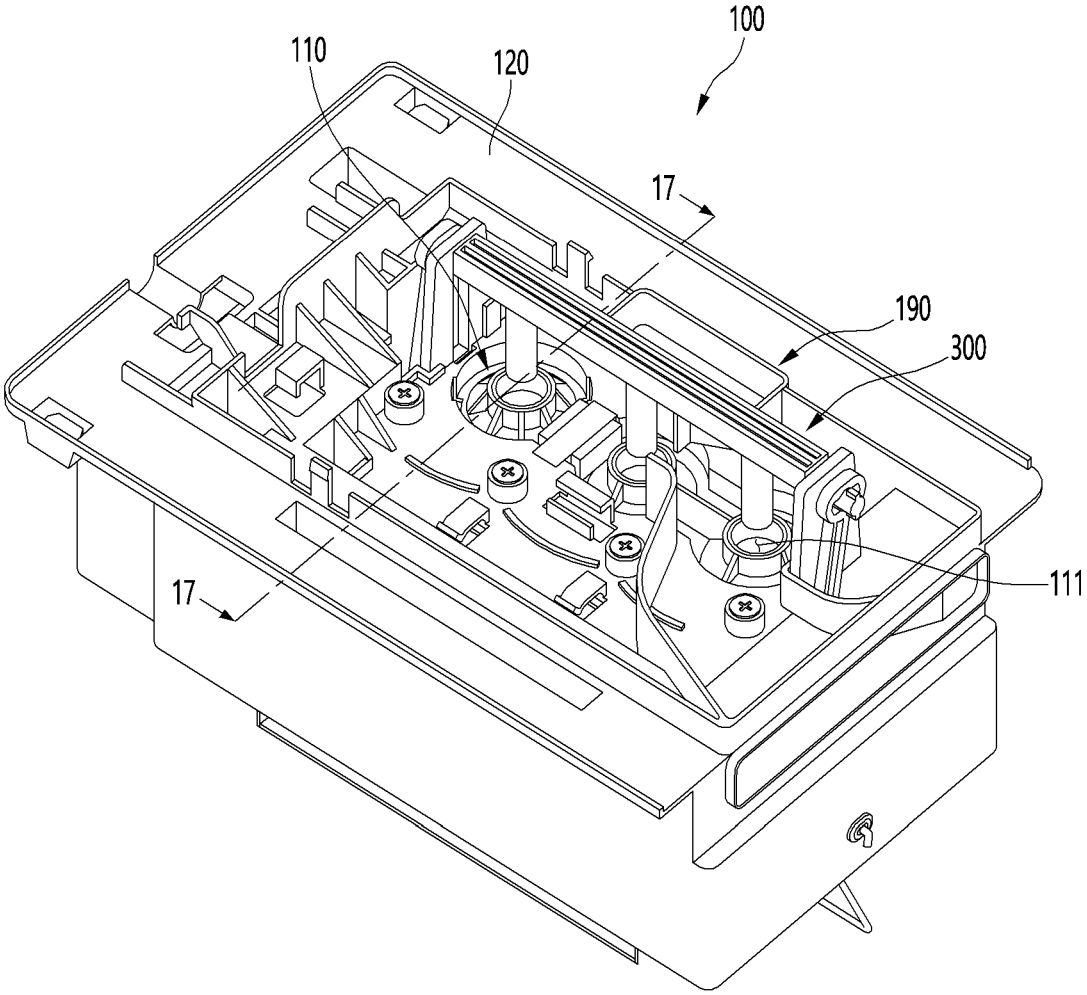
FIG. 3 is a top perspective view of an ice maker according to one embodiment of the present disclosure.
Figure 4:
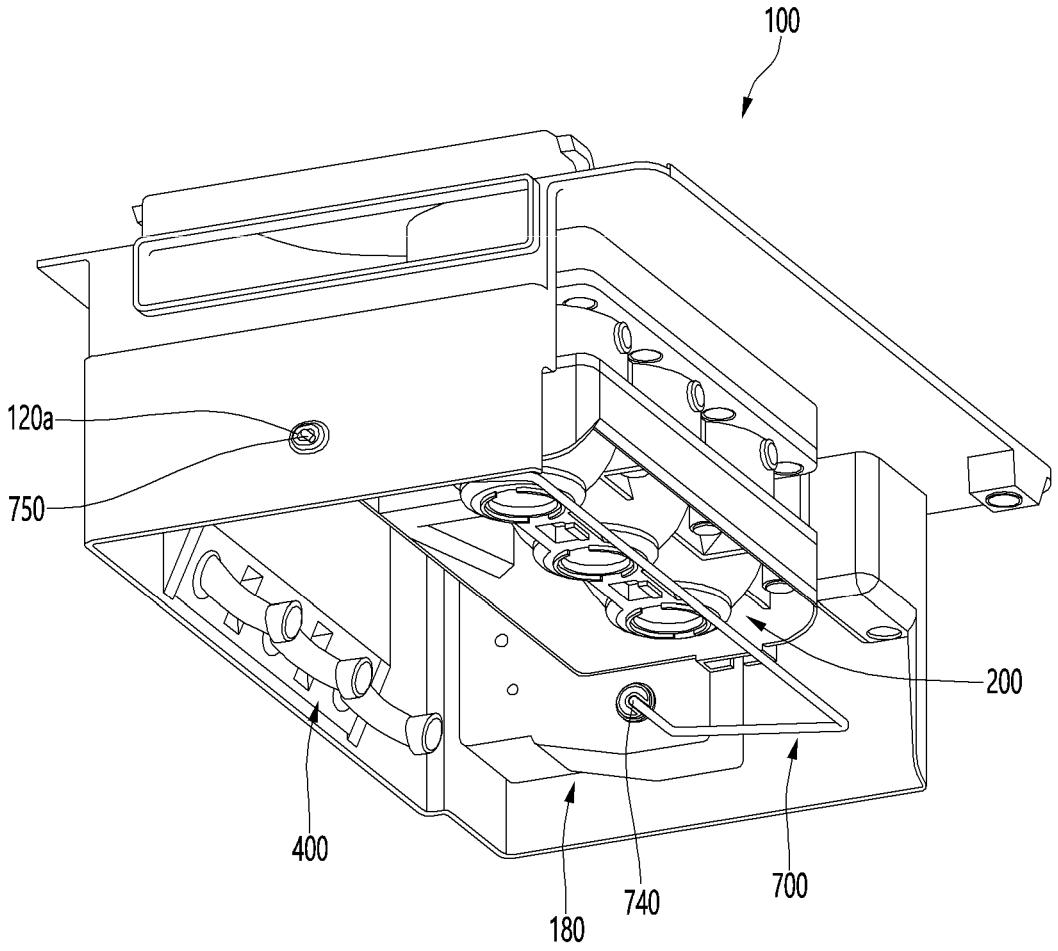
FIG. 4 is a bottom perspective view of an ice maker seen from at a lower side of the ice maker according to one embodiment of the present disclosure.

FIG. 3 is a top perspective view of the ice maker according to an embodiment; FIG. 4 is a bottom perspective view of the ice maker according to an embodiment and FIG. 5 is an exploded perspective view of the ice maker according to an embodiment.

Figure 5:
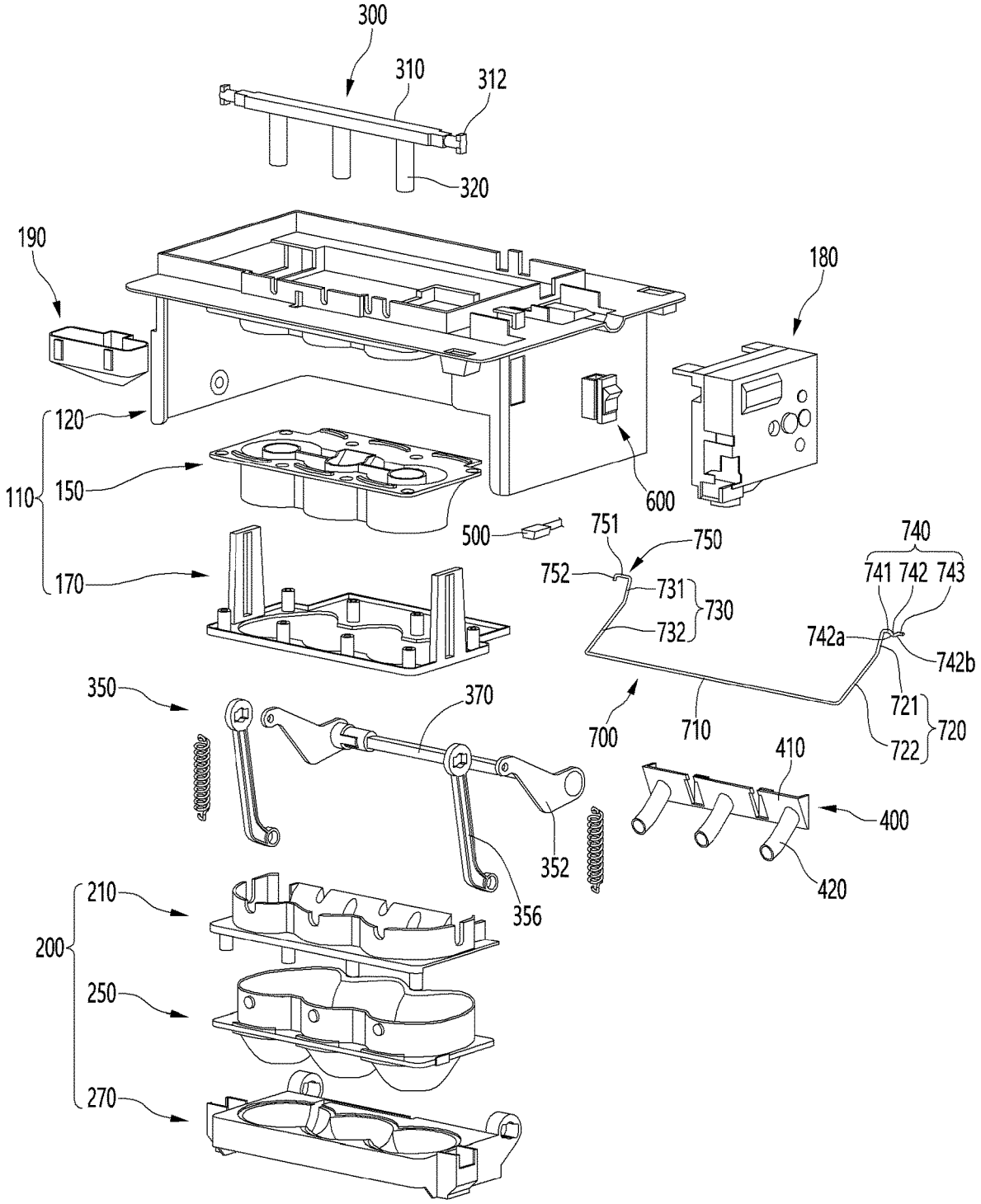
FIG. 5 is an exploded perspective view of an ice maker according to one embodiment of the present disclosure.

Referring to FIGS. 3 to 5, the ice maker 100 may include an upper assembly 110 and a lower assembly 200. The upper assembly 110 may be called as a first tray assembly, and the lower assembly 200 may be called as a second tray assembly.

The lower assembly 200 may movable with respect to the upper assembly 110. For example, the lower assembly 200 may be rotatable with respect to the upper assembly 110.

In a state in which the lower assembly 200 contacts the upper assembly 110, the lower assembly 200 together with the upper assembly 110 may make spherical ice. That is, the upper assembly 110 and the lower assembly 200 may define an ice chamber 111 for making the spherical ice. The ice chamber 111 may have a chamber having a substantially spherical shape. Of course, it is also possible for the upper assembly 110 and the lower assembly 200 to generate ice in various shapes other than the spherical shape.

As used herein, a term "spherical or hemisphere form" not only includes a geometrically complete sphere or hemisphere form but also a geometrically complete sphere-like or geometrically complete hemisphere-like form.

The upper assembly 110 and the lower assembly 200 may define a plurality of ice chambers 111. Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and one or more upper ejecting pins 320 extending in a direction crossing the ejector body 310. The upper ejecting pins 320 may be provided in the same number of ice chambers 111, but are not limited thereto.

A separation prevention protrusion 312 for preventing a connection unit 350 from being separated in the state of being coupled to the connection unit 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed. The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and one or more lower ejecting pins 420 protruding from the ejector body 410. The lower ejecting pins 420 may be provided in the same number of ice chambers 111, but are not limited thereto.

While the lower assembly 200 rotates to transfer the ice, rotation force of the lower assembly 200 may be transmitted to the upper ejector 300. For this, the ice maker 100 may further include the connection unit 350 connecting the lower assembly 200 to the upper ejector 300. The connection unit 350 may include one or more links.

For example, the connection unit 350 may include a first link 352 for rotating the lower assembly 200 and a second link 356 connected with the lower supporter 270 of the lower assembly 200 to transmit the rotational force of the lower supporter 270 to the upper ejector 300 during the rotation of the lower supporter 270.

For example, when the lower assembly 200 rotates in one direction, the upper ejector 300 may descend by the connection unit 350 to allow the upper ejector pin 320 to press the ice.

On the other hand, when the lower assembly 200 rotates in the other direction, the upper ejector 300 may ascend by the connection unit 350 to return to its original position.

Hereinafter, the upper assembly 110 and the lower assembly 200 will be described in more detail.

The upper assembly 110 may include an upper tray 150 defining a portion of the ice chamber 111 making the ice. For example, the upper tray 150 may define an upper portion of the ice chamber 111. The upper tray 150 may be called as a first tray.

The upper assembly 110 may further include upper case 120 and an upper support 170 fixing a position of the upper tray 150.

The upper tray 150 may be disposed below the upper case 120. A portion of the upper support 170 may be disposed below the upper tray 150. As described above, the upper case 120, the upper tray 150, and the upper support 170, which are vertically aligned, may be coupled to each other through a coupling member. That is, the upper tray 150 may be fixed to the upper case 120 through coupling of the coupling member. The upper support 170 may restrict downward movement of the upper tray 150.

For example, the water supply part 190 may be fixed to the upper case 120.

The ice maker 100 may further include a temperature sensor 500 (or tray temperature sensor) detecting a temperature of water or ice of the ice chamber 111. In one example, the temperature sensor 500 detects the temperature of the upper tray 150 thus to indirectly detect the temperature of the water or the temperature of the ice in the ice chamber 111.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111. The lower tray 250 may be called as a second tray.

The lower assembly 200 may further include a lower support 270 supporting a lower portion of the lower tray 250, and a lower case 210 of which at least a portion covers an upper side of the lower tray 250.

The lower case 210, the lower tray 250 and the lower support 270 are coupled to each other by a coupling member.

The ice maker 100 may further include a switch for turning on/off the ice maker 100. When the user turns on the switch 600, the ice maker 100 may make ice. That is, when the switch 600 is turned on, water may be supplied to the ice maker 100. Then, an ice making process of making ice by using cold air and an ice separating process of transferring the ice through the rotation of the lower assembly 200. On the other hand, when the switch 600 is manipulated to be turned off, the making of the ice through the ice maker 100 may be impossible. For example, the switch 600 may be provided in the upper case 120.

The ice maker 100 may further include an ice fullness detection lever 700. For example, the ice fullness detection lever 700 may detect whether the ice fullness of the ice bean 102 while rotating by receiving power from the driving unit 180.

One side of the ice fullness detection lever 700 may be connected to the driving unit 180, and the other side thereof may be connected to the upper case 120. For example, the other side of the ice fullness detection lever 700 may be rotatably connected to the upper case 120 below the connection shaft 370 of the connection unit 350. Accordingly, the rotation center of the ice fullness detection lever 700 may be positioned lower than the connection shaft 370.

The power transmission unit of the driving unit 180 may include, for example, a plurality of gears.

In addition, the driving unit 180 may further include a cam rotated by receiving rotational power of the driving motor, and a moving lever moving along the cam surface. The magnet may be provided on the moving lever. The driving unit 180 may further include a Hall sensor capable of detecting the magnet in a process in which the moving lever moves.

Among the plurality of gears of the driving unit 180, a first gear to which the ice fullness detection lever 700 is coupled may be selectively coupled to or released from a second gear meshed with the first gear. For example, since the first gear is elastically supported by an elastic member, the first gear may mesh with the second gear in a state where no external force is applied.

On the other hand, when a resistance greater than the elastic force of the elastic member is applied to the first gear, the first gear may be spaced apart from the second gear. A case where a resistance greater than the elastic force of the elastic member is applied to the first gear, for example, is a case where the ice fullness detection lever 700 is caught in ice during the ice separation process (in case of ice fullness). In this case, since the first gear may be spaced apart from the second gear, damage to the gears may be prevented.

Due to the plurality of gears and cams, the ice fullness detection lever 700 may be rotated in a state of being interlocked with the lower assembly 200 when the lower assembly 200 is rotated. In this case, the cam may be connected to the second gear or interlocked with the second gear.

According to whether the Hall sensor detects a magnet, the Hall sensor may output a first signal and a second signal that are different outputs from each other. One of the first signal and the second signal may be a high signal, and the other may be a low signal.

The ice fullness detection lever 700 may be rotated from a stand-by position (ice making position of the lower assembly) to an ice fullness detection position for ice fullness detection.

In a state where the ice fullness detection lever 700 is positioned in the standby position, at least a portion of the ice fullness detection lever 700 may be located below the lower assembly 200.

The ice fullness detection lever 700 may include a detection body 710. The detection body 710 may be located at the lowermost side during the rotation operation of the ice fullness detection lever 700. The entirety of the detection body 710 may be positioned below the lower assembly 200 to prevent interference between the lower assembly 200 and the detection body 710 during the rotation of the lower assembly 200.

The detection body 710 may contact the ice in the ice bin 102 in a state of the ice fullness of the ice bin 102.

The ice fullness detection lever 700 may be a wire-shaped lever. That is, the ice fullness detection lever 700 may be formed by bending a wire having a predetermined diameter a plurality of times.

The detection body 710 may extend in a direction parallel to an extension direction of the connection shaft 370. The detection body 710 may be positioned lower than the lowest point of the lower assembly 200 irrespective of the position of the detection body.

The ice fullness detection lever 700 may further include a pair of extension parts 720 and 730 extending upward from both ends of the detection body 710.

The pair of extension parts 720 and 730 may extend substantially in parallel. The pair of extension parts 720 and 730 may include a first extension part 720 and a second extension part 730.

A horizontal length of the detection body 710 may be longer than a vertical length of each of the pair of extension parts 720 and 730. A distance between the pair of extension parts 720 and 730 may be longer than a horizontal length of the lower assembly 200.

Accordingly, interference between the pair of extension parts 720 and 730 and the lower assembly 200 can be prevented during the rotation of the ice fullness detection lever 700 and the rotation of the lower assembly 200.

Each of the pair of extension parts 720 and 730 may include a first extension bar 722 and 732 extending from the detection body 710 and a second extension bar 721 and 731 extending to be inclined at a predetermined angle from the first extension bar 722 and 732, respectively.

The ice fullness detection lever 700 may further include a pair of coupling parts 740 and 750 that are bent and extended from the ends of the pair of extension parts 720 and 730.

The pair of coupling parts 740 and 750 may include a first coupling part 740 extending from the first extension part 720 and a second coupling part 750 extending from the second extension part 730.

For example, the pair of coupling parts 740 and 750 may extend from the second extension bars 721 and 731. The first coupling part 740 and the second coupling part 750 may extend in a direction away from each other in the respective extension parts 720 and 730.

The first coupling part 740 may be connected to the driving unit 180, and the second coupling part 750 may be connected to the upper case 120.

At least a portion of the first coupling part 740 may extend in a horizontal direction. That is, at least a portion of the first coupling part 740 may be parallel to the detection body 710.

The first coupling part 740 and the second coupling part 750 provide a rotation center of the ice fullness detection lever 700.

In this embodiment, the second coupling part 750 may be coupled to the upper case 120 in an idle state. Accordingly, the first coupling part 740 may substantially provide a rotation center of the ice fullness detection lever 700.

The first coupling part 740 may include a first horizontal extension part 741 extending in a horizontal direction from the first extension part 720. The first coupling part 740 may further include a bent part 742 bent at the first horizontal extension part 741. Although not limited, the bent part 742 may be formed to be inclined downward in a direction away from the first horizontal extension part 741 and then inclined upward again.

For example, the bent part 742 may include a first inclined part 742*a* that is inclined downward from the first horizontal extension part 741 and a second inclined part 742*b* that is inclined upward from the first inclined part 742*a*. A boundary part between the first inclined part 742*a* and the second inclined part 742*b* may be positioned at the lowermost side of the first coupling part 740. The reason why the first coupling part 740 includes the bent part 742 is to increase coupling force with the driving unit 180.

The first coupling part 740 may further include a second horizontal extension part 743 extending in a horizontal direction from an end of the bent part 742. For example, the second horizontal extension part 743 may extend in a horizontal direction from the second inclined part 742*b*.

The second horizontal extension part 743 and the first horizontal extension part 741 may be positioned at the same height with respect to the detection body 710. That is, the first horizontal extension part 741 and the second horizontal extension part 743 may be positioned on the same extension line.

As another example, in this embodiment, the first coupling part 740 may include only the first horizontal extension part 741 or include only the first horizontal extension part 741 and the bent part 742. Alternatively, the first coupling part 740 may include only the bent part 742 and the second horizontal extension part 743.

The second coupling part 750 may include a coupling body 751 extending in a horizontal direction from the second extending part 730 and an engagement body 752 bent at the coupling body 751. The coupling body 751 may extend in parallel with the engagement body 710, for example. The engagement body 752 may extend in the vertical direction, for example. The engagement body 752 may extend downward from the coupling body 751. The engagement body 752 may extend in parallel with the second extension part 740.

The second coupling part 750 may pass through the upper case 120. A hole 120*a* through which the second coupling part 750 passes may be formed in the upper case 120.

Figure 6:
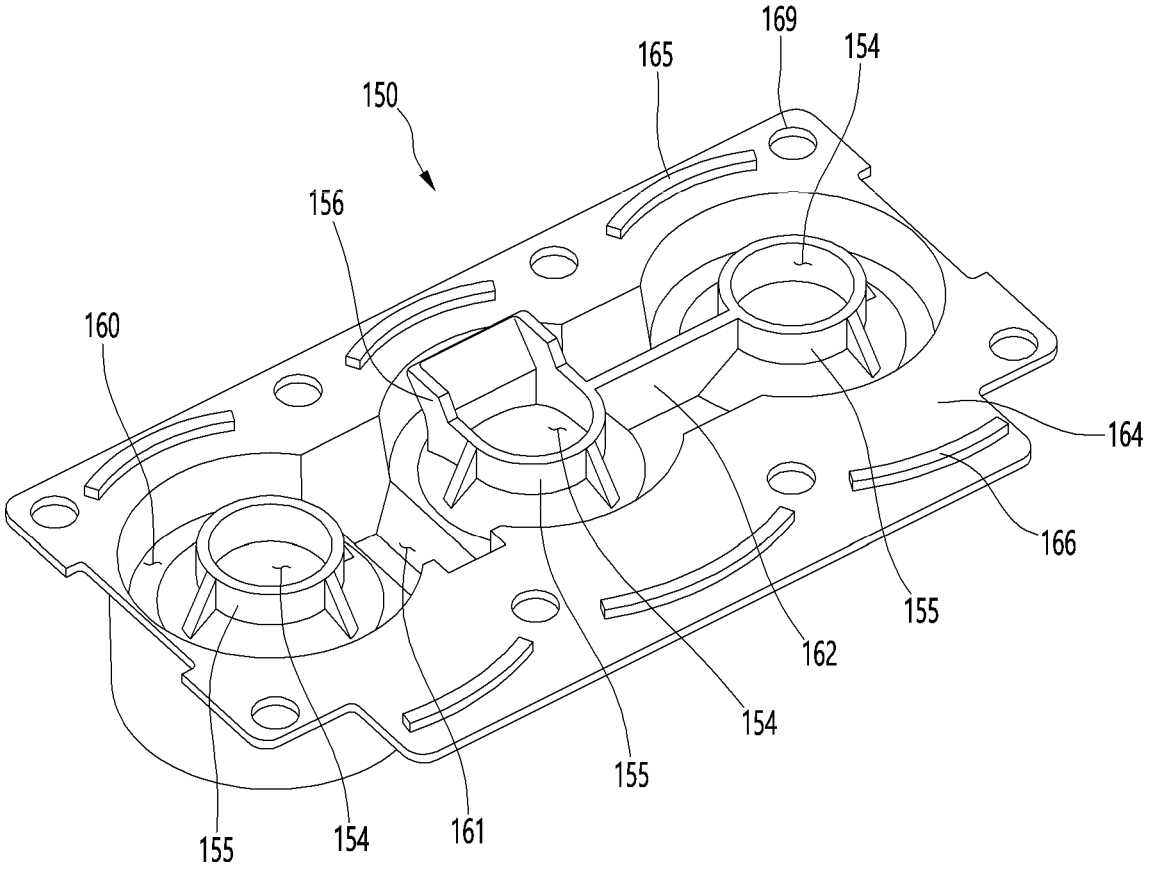
FIG. 6 is a top perspective view of an upper tray according to one embodiment of the present disclosure.
Figure 7:
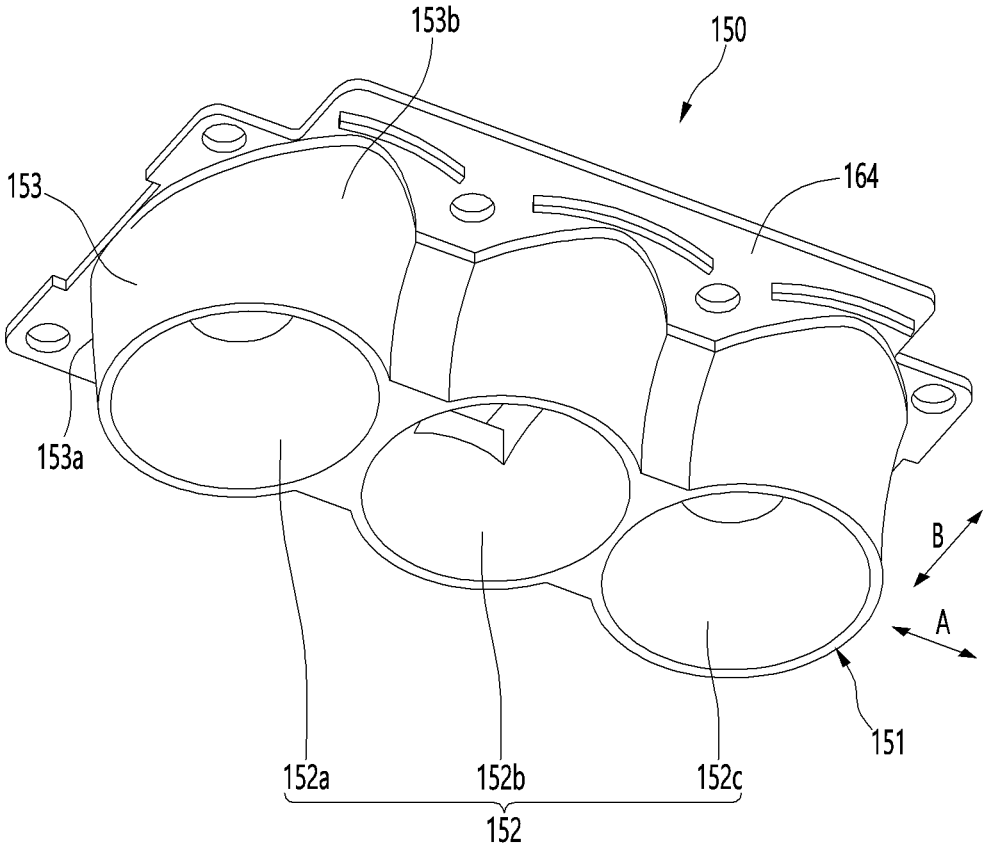
FIG. 7 is a bottom perspective view of an upper tray according to one embodiment of the present disclosure.

FIG. 6 is a top perspective view of the upper tray according to an embodiment, and FIG. 7 is a bottom perspective view of the upper tray according to an embodiment.

Figure 8:
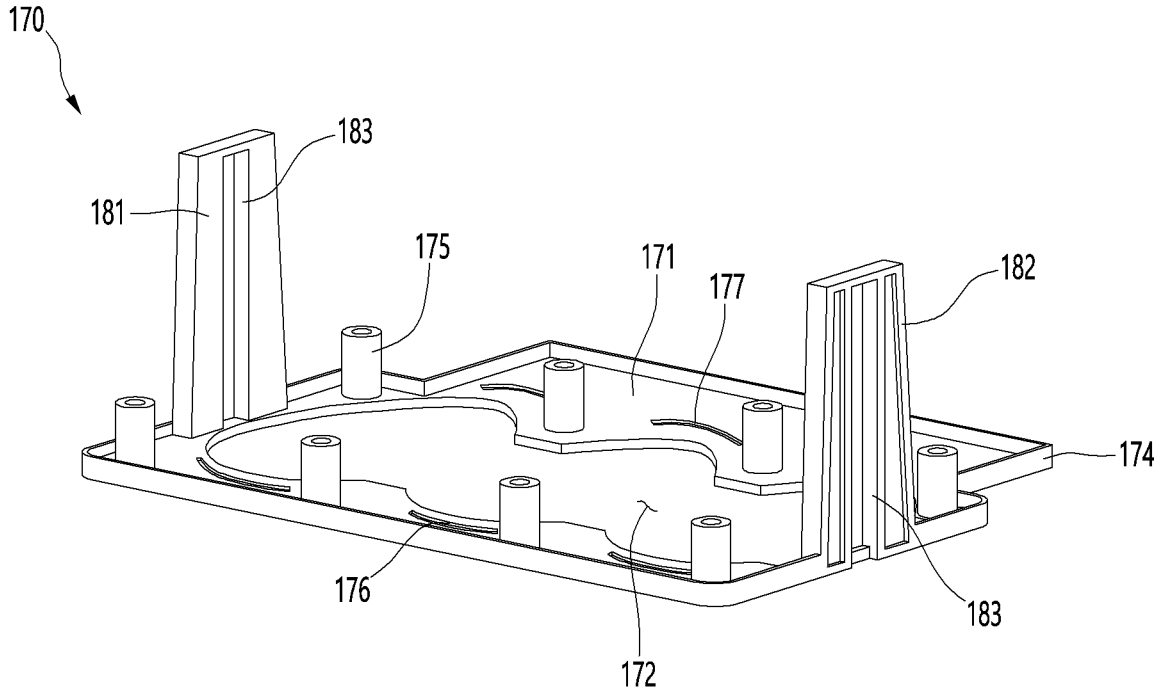
FIG. 8 is a top perspective view of an upper support according to one embodiment of the present disclosure.
Figure 9:
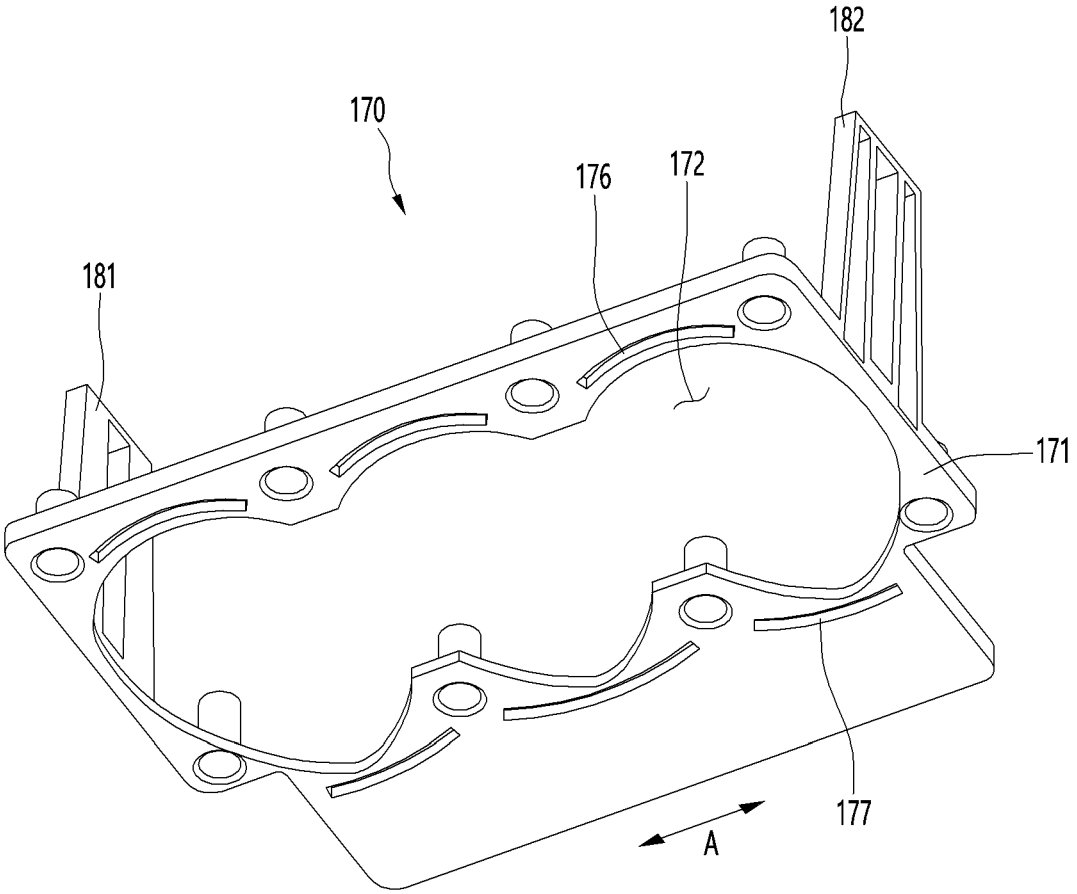
FIG. 9 is a bottom perspective view of an upper support according to one embodiment of the present disclosure.

Referring to FIGS. 8 and 9, the upper tray 150 may be made of a flexible material or a ductile material that is capable of being restored to its original shape after being deformed by an external force.

For example, the upper tray 150 may be made of a silicone material. Like this embodiment, when the upper tray 150 is made of the silicone material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more. In this case, after the upper tray 150 is deformed in shape, the spherical ice may not be made. That is, it is impossible to repeatedly make the spherical ice.

On the other hand, like this embodiment, when the upper tray 150 is made of the flexible material or the ductile material that is capable of being restored to its original shape, this limitation may be solved. Also, when the upper tray 150 is made of the silicone material, the upper tray 150 may be prevented from being melted or thermally deformed by heat provided from an upper heater that will be described later.

The upper tray 150 may include an upper tray body 151 defining an upper chamber 152 that is a portion of the ice chamber 111. The upper tray body 151 may be define a plurality of upper chambers 152. For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body. The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 7.

For example, the upper chamber 152 may have a hemispherical shape. That is, an upper portion of the spherical ice may be made by the upper chamber 152.

An upper opening 154 to introduce water to the upper chamber 152 may be defined in an upper side of the upper tray body 151. For example, three upper openings 154 may be defined in the upper tray body 151. Cold air may be guided into the ice chamber 111 through the upper opening 154.

In the ice separating process, the upper ejector 300 may be inserted into the upper chamber 152 through the upper opening 154. While the upper ejector 300 is inserted through the upper opening 154, an inlet wall 155 may be provided on the upper tray 150 to minimize deformation of the upper opening 154 in the upper tray 150. The inlet wall 155 may be disposed along a circumference of the upper opening 154 and extend upward from the upper tray body 151.

The inlet wall 155 may have a cylindrical shape. Thus, the upper ejector 30 may pass through the upper opening 154 via an inner space of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*. Although not limited, the water supply guide 156 may be provided in the inlet wall corresponding to the second upper chamber 152*b*. The water supply guide 156 may be inclined upward from the inlet wall 155 in a direction which is away from the second upper chamber 152*b*.

The upper tray 150 may further include a first accommodation part 160. The heater coupling part 124 of the upper case 120 (see reference numeral 148 of FIG. 10) may be accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward. A heater coupling part to which the upper heater (see reference numeral 148 of FIG. 14) is coupled is accommodated in the first accommodation part 160.

The upper tray 150 may further include a second accommodation part 161 (or referred to as a sensor accommodation part) in which the temperature sensor 500 is accommodated. For example, the second accommodation part 161 may be provided in the upper tray body 151. Although not limited, the second accommodation part 161 may be provided by recessing a bottom surface of the first accommodation part 160 downward.

The second accommodation part 161 may be disposed between the two upper chambers adjacent to each other. For example, the second accommodation part 161 may be disposed between the first upper chamber 152*a* and the second upper chamber 152*b*. Thus, an interference between the upper heater (see reference numeral 148 of FIG. 14) accommodated in the first accommodation part 160 and the temperature sensor 500 may be prevented.

In the state in which the temperature sensor 500 is accommodated in the second accommodation part 161, the temperature sensor 500 may contact an outer face of the upper tray body 151.

The chamber wall 153 of the upper tray body 151 may include a vertical wall 153*a* and a curved wall 153*b*. The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151. The horizontal extension part 164 may contact the upper case 120 and the upper support 170. For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120. At least a portion of the horizontal extension part 164 may be disposed between the upper case 120 and the upper support 170.

The horizontal extension part 164 may include a plurality of upper protrusions 165 and 166 respectively coupled to the upper case 120. The plurality of upper protrusions 165 and 166 may protrude upward from the top surface 164*a* of the horizontal extension part 164. For example, the plurality of upper protrusions 165 and 166 may be provided in a curved shape. In this embodiment, each of the upper protrusions 165 and 166 may be constructed so that the upper tray 150 and the upper case 120 are coupled to each other, and also, the horizontal extension part is prevented from being deformed during the ice making process or the ice separating process.

The horizontal extension part 164 may further include a plurality of lower protrusions 167 and 168. The plurality of lower protrusions 167 and 168 (see reference numeral 167 and 168 of FIG. 11) may be inserted into a lower slot of the upper support 170, which will be described below. The plurality of lower protrusions (see reference numeral 167 and 168 of FIG. 11) may protrude downward from the bottom surface 164*b* of the horizontal extension part 164. The plurality of lower protrusions (see reference numeral 167 and 168 of FIG. 11) may also be provided in a curved shape.

A through-hole 169 through which the coupling boss of the upper support 170, which will be described later, may be provided in the horizontal extension part 164. For example, a plurality of through-holes 169 may be provided in the horizontal extension part 164.

FIG. 8 is a top perspective view of the upper support according to an embodiment, and FIG. 9 is a bottom perspective view of the upper support according to an embodiment.

Referring to FIGS. 8 and 9, the upper support 170 may include a support plate 171 contacting the upper tray 150. For example, a top surface of the support plate 171 may contact the bottom surface 164*b* of the horizontal extension part 164 of the upper tray 150.

A plate opening 172 through which the upper tray body 151 passes may be defined in the support plate 171. A circumferential wall 174 that is bent upward may be provided on an edge of the support plate 171. For example, the circumferential wall 174 may contact at least a portion of a circumference of a side surface of the horizontal extension part 164. A top surface of the circumferential wall 174 may contact a bottom surface of the upper plate 121.

The support plate 171 may include a plurality of lower slots 176 and 177. The plurality of lower protrusion 167 and 168 are inserted in the plurality of lower slots 176 and 177.

The support plate 171 may further include a plurality of coupling bosses 175. The plurality of coupling bosses 175 may protrude upward from the top surface of the support plate 171. Each of the coupling bosses 175 may pass through the through-hole 169 of the horizontal extension part 164.

The upper support 170 may further include a plurality of unit guides 181 and 182 for guiding the connection unit 350 connected to the upper ejector 300. The plurality of unit guides 181 and 182 may be, for example, disposed to be spaced apart from each other in the direction of the arrow A with respect to FIG. 9.

The unit guides 181 and 182 may extend upward from the top surface of the support plate 171. Each of the unit guides 181 and 182 may be connected to the circumferential wall 174.

Each of the unit guides 181 and 182 may include a guide slot 183 vertically extends. In a state in which both ends of the ejector body 310 of the upper ejector 300 pass through the guide slot 183, the connection unit 350 is connected to the ejector body 310. Thus, when the rotation force is transmitted to the ejector body 310 by the connection unit 350 while the lower assembly 200 rotates, the ejector body 310 may vertically move along the guide slot 183.

Figure 10:
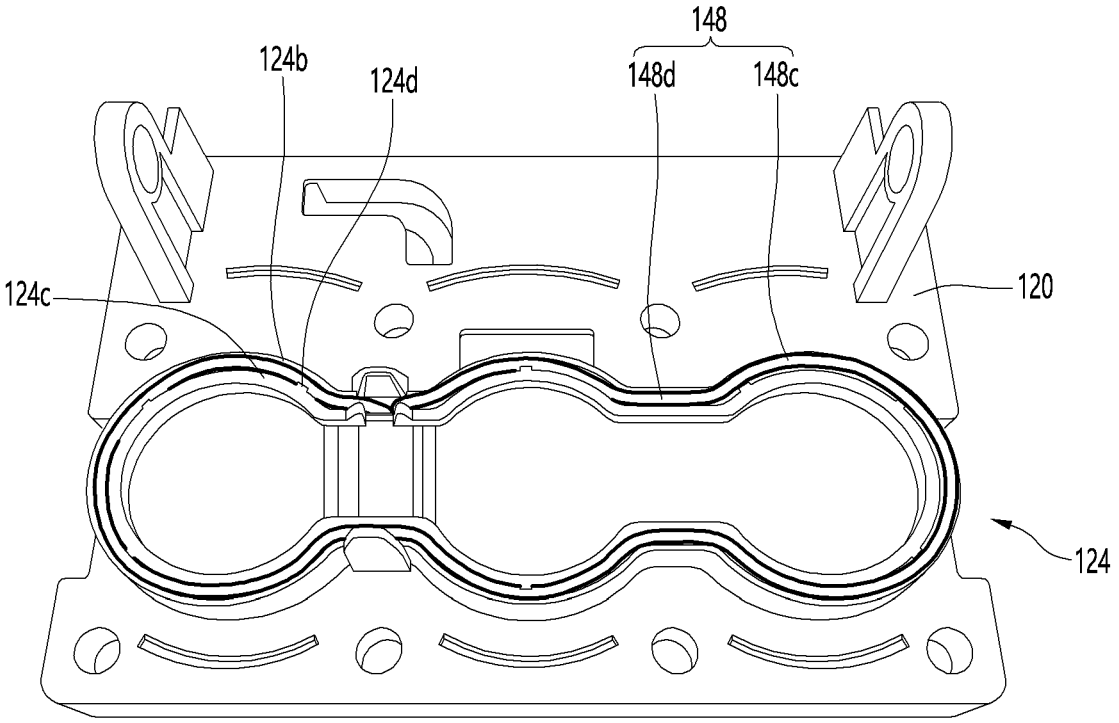
FIG. 10 is a view showing a state in which a heater is coupled to the upper case.

FIG. 10 is a view illustrating a state in which a heater is coupled to the upper case.

Referring to FIG. 10, the upper case 12 may include heater coupling part 124. The heater coupling part 124 may include a heater accommodation groove 124*a* accommodating the upper heater 148. The upper heater 148 may be called as a first heater.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove.

The upper heater 148 may be a DC heater receiving DC power. The upper heater 148 may be turned on to transfer ice. When heat of the upper heater 148 is transferred to the upper tray 150, ice may be separated from a surface (inner face) of the upper tray 150.

If the upper tray 150 is made of a metal material, and the heat of the upper heater 148 has a high temperature, a portion of the ice, which is heated by the upper heater 148, may be adhered again to the surface of the upper tray after the upper heater 148 is turned off. As a result, the ice may be opaque. That is, an opaque band having a shape corresponding to the upper heater may be formed around the ice.

However, in this embodiment, since the DC heater having low output is used, and the upper tray 150 is made of the silicone material, an amount of heat transferred to the upper tray 150 may be reduced, and thus, the upper tray itself may have low thermal conductivity.

Thus, the heat may not be concentrated into the local portion of the ice, and a small amount of heat may be slowly applied to prevent the opaque band from being formed around the ice because the ice is effectively separated from the upper tray.

The upper heater 148 may be disposed to surround the circumference of each of the plurality of upper chambers 152 so that the heat of the upper heater 148 is uniformly transferred to the plurality of upper chambers 152 of the upper tray 150.

The upper heater 148 may contact the circumference of each of the chamber walls 153 respectively defining the plurality of upper chambers 152. Here, the upper heater 148 may be disposed at a position that is lower than that of the upper opening 154.

The heater accommodation groove 124*a* may be defined by an outer wall 124*b* and an inner wall 124*c*. The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*. Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on at least one of the outer wall 124*b* and the inner wall 124*c* to prevent the upper heater 148 accommodated in the heater accommodation groove 124*a* from being separated from the heater accommodation groove 124*a*. In FIG. 10, for example, a plurality of separation prevention protrusions 124*d* are provided on the inner wall 124*c*. The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*. As illustrated in FIG. 10, in the state in which the upper heater 148 is accommodated in the heater accommodation groove 124*a*, the upper heater 148 may be divided into a rounded portion 148*c* and a portion 148*d*. That is, the heater accommodation groove 124*a* may include a rounded portion and a linear portion. Thus, the upper heater 148 may be divided into the rounded portion 148*c* and the linear portion 148*d* to correspond to the rounded portion and the portion of the heater accommodation groove 124*a*.

The rounded portion 148*c* may be a portion disposed along the circumference of the upper chamber 152 and also a portion that is bent to be rounded in a horizontal direction. The linear portion 148*d* may be a portion connecting the upper rounded portions 148*c* corresponding to the upper chambers 152 to each other.

Since the upper heater 148 is disposed at a position lower than that of the upper opening 154, a line connecting two points of the rounded portions, which are spaced apart from each other, to each other may pass through upper chamber 152. Since the rounded portion 148*c* of the upper heater 148 may be separated from the heater accommodation groove 124*a*, the separation prevention protrusion 124*d* may be disposed to contact the upper rounded portion 148*c*.

Figure 11:
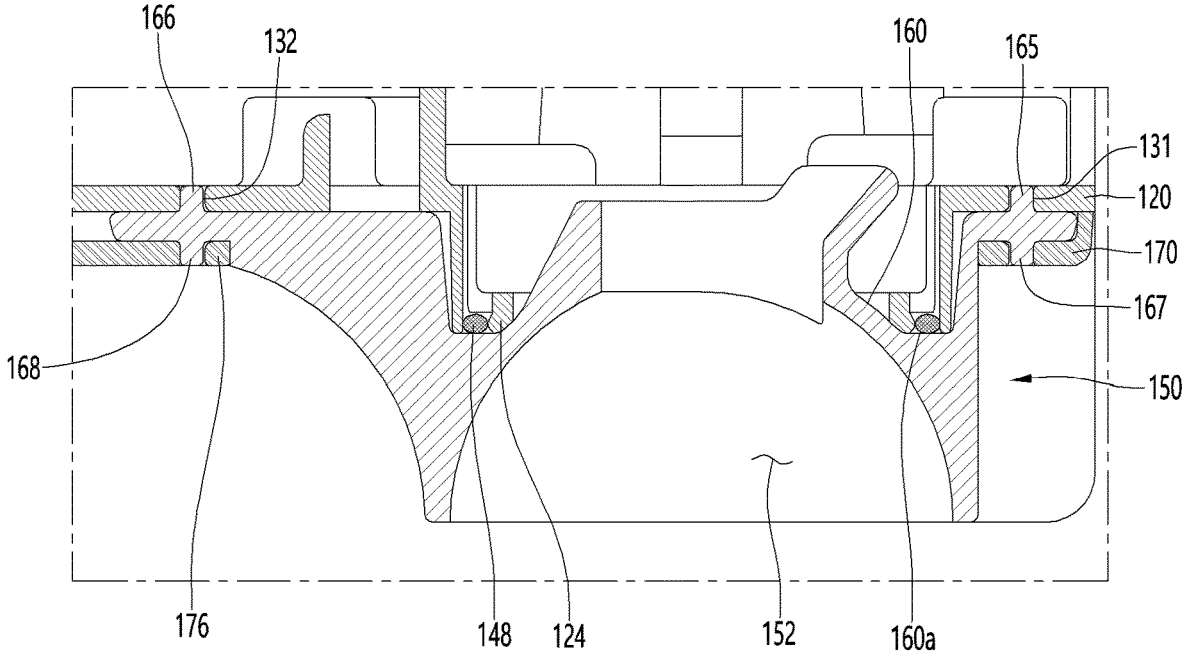
FIG. 11 is a sectional view showing a state in which the upper assembly has been assembled.

FIG. 11 is a cross-sectional view illustrating a state in which an upper assembly is assembled.

Referring to FIGS. 3, 10 and 11, in the state in which the upper heater 148 is coupled to the heater coupling part 124 of the upper case 120, the upper case 120, the upper tray 150, and the upper support 170 may be coupled to each other.

When the upper assembly 110 is assembled, the heater coupling part 124 to which the upper heater 148 is coupled may be accommodated in the first accommodation part 160 of the upper tray 150. In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the rounded portion 148*c* of the upper heater 148 may vertically overlap the upper chamber 152. That is, the maximum distance between two points of the round part 148*c* positioned opposite to the upper chamber 152 is formed to be smaller than the diameter of the upper chamber 152.

Figure 12:
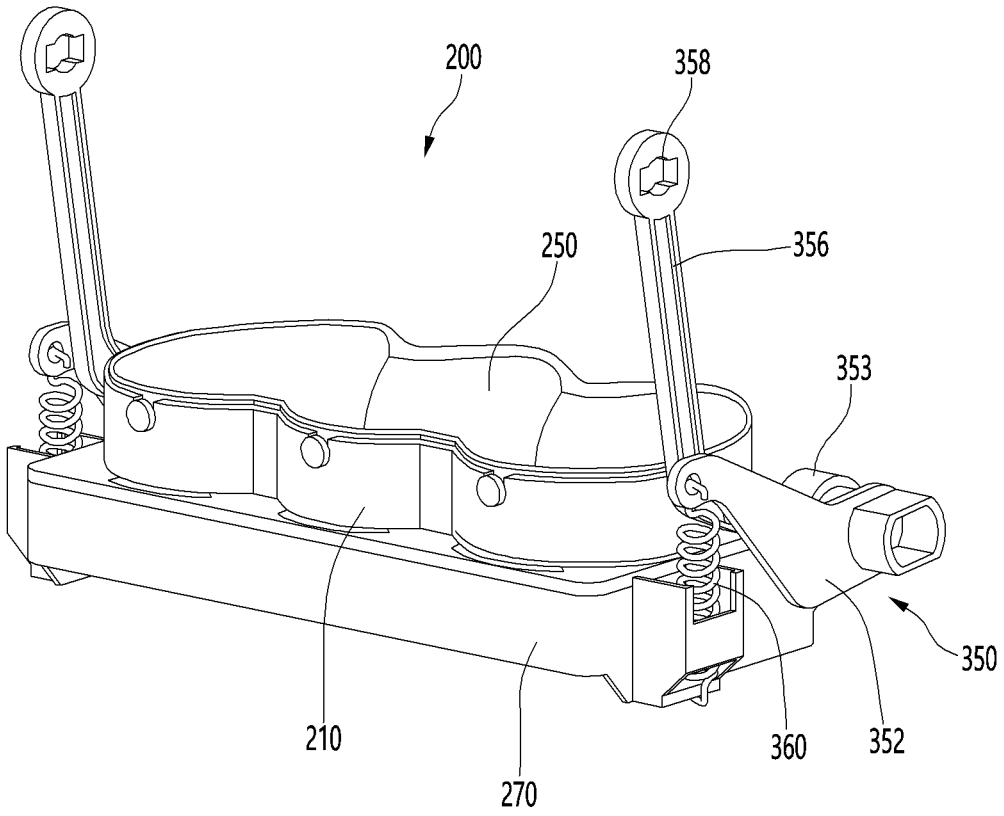
FIG. 12 is a perspective view of a lower assembly according to one embodiment of the present disclosure.

FIG. 12 is a perspective view of a lower assembly according to an embodiment.

Referring to FIG. 12, the lower assembly 200 may include a lower tray 250 and a lower support 270.

The lower assembly 200 may further include a lower case 210.

The lower case 210 may surround a portion of the circumference of the lower tray 250, and the lower support 270 may support the lower tray 250.

The connection unit 350 may be coupled to the lower support 270.

The connection unit 350 may include a first link 352 that receives power of the driving unit 180 to allow the lower support 270 to rotate and a second link 356 connected to the lower support 270 to transmit rotation force of the lower support 270 to the upper ejector 300 when the lower support 270 rotates.

The first link 352 and the lower support 270 may be connected to each other by an elastic member 360. For example, the elastic member 360 may be a coil spring. The elastic member 360 may have one end connected to the first link 362 and the other end connected to the lower support 270. The elastic member 360 provide elastic force to the lower support 270 so that contact between the upper tray 150 and the lower tray 250 is maintained.

In this embodiment, the first link 352 and the second link 356 may be disposed on both sides of the lower support 270, respectively. One of the two first links may be connected to the driving unit 180 to receive the rotation force from the driving unit 180. The two first links 352 may be connected to each other by a connection shaft. A hole 358 through which the ejector body 310 of the upper ejector 300 passes may be defined in an upper end of the second link 356.

Figure 13:
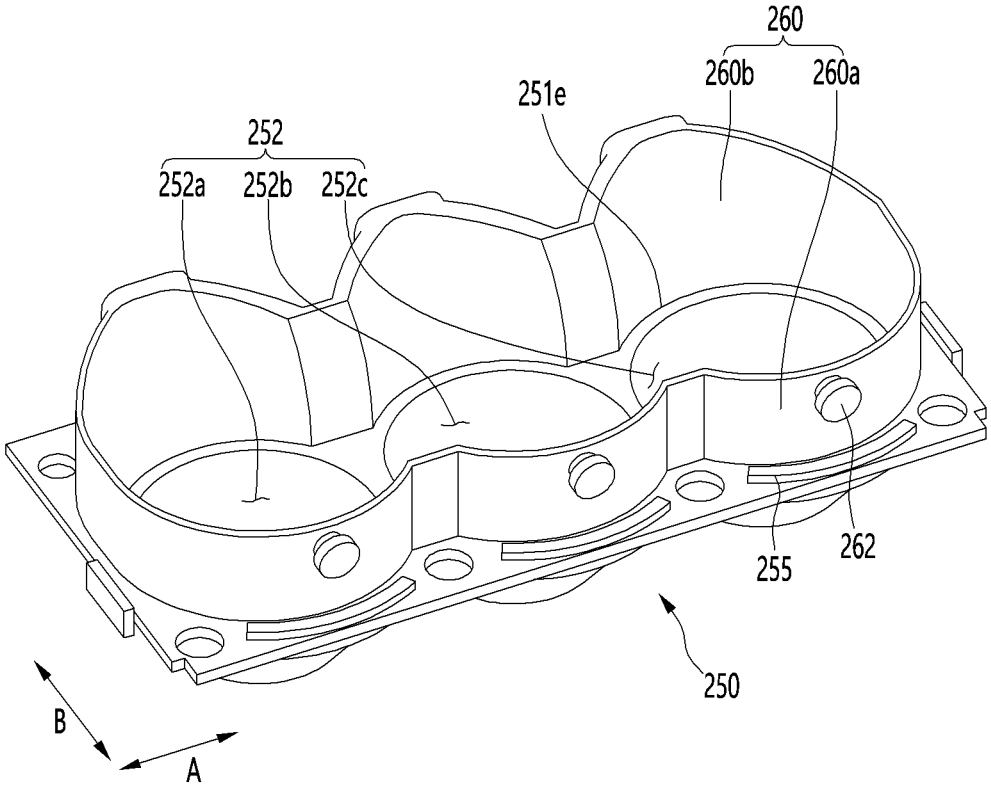
FIG. 13 is a top perspective view of a lower tray according to one embodiment of the present disclosure.
Figure 14:
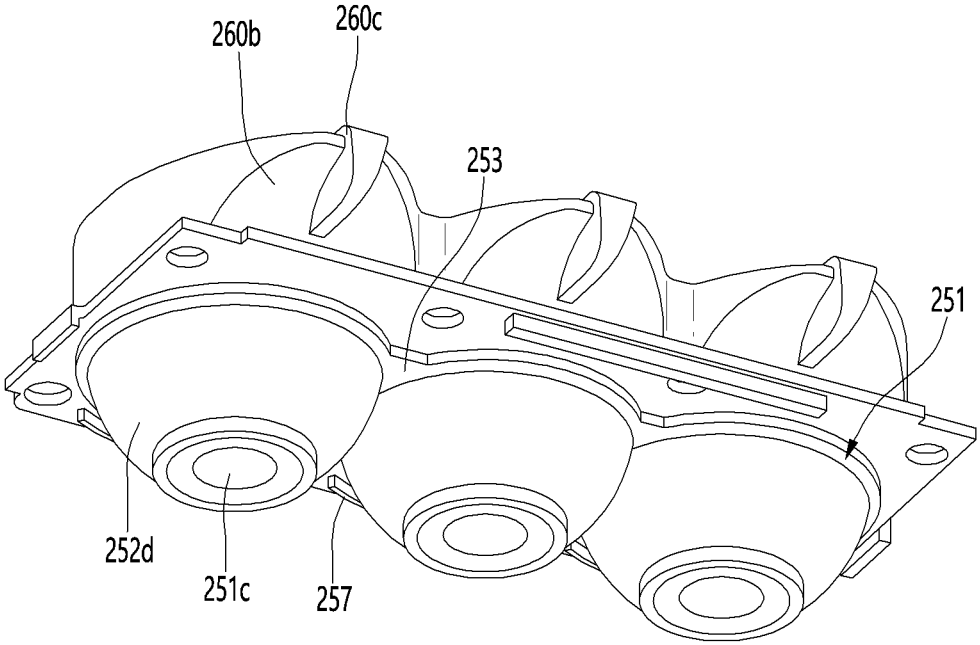
FIG. 14 is a bottom perspective view of a lower tray according to one embodiment of the present disclosure.

FIG. 13 is a top perspective view of the lower tray according to an embodiment, FIG. 14 is a bottom perspective view of the lower tray according to an embodiment.

Referring to FIGS. 13 and 14, the lower tray 250 may be made of a flexible material or a ductile material that is capable of being restored to its original shape after being deformed by an external force.

For example, the lower tray 250 may be made of a silicone material. Like this embodiment, when the lower tray 250 is made of a silicone material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more. In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved. When the lower tray 250 is made of the silicone material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may be define a plurality of lower chambers 252. For example, the plurality of lower chambers 252 may include a first lower chamber 252*a*, a second lower chamber 252*b*, and a third lower chamber 252*c*. The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 13.

Accordingly, the lower chamber 252 may have a hemispherical shape or a shape similar to the hemispherical shape. That is, a lower portion of the spherical ice may be made by the lower chamber 252.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extended upward from an upper surface of the first extension part 253. A bottom surface of the upper tray body 151 may contact a top surface 251*e* of the lower tray body 251. The circumferential wall 260 may surround the upper tray body 251 seated on the top surface 251*e* of the lower tray body 251. The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260. The second extension part 254 may be disposed higher than the first extension part 253. Thus, the first extension part 253 and the second extension part 254 may be stepped with respect to each other.

The second extension part 254 may include an upper protrusion 255 inserted into the lower case 210.

The second extension part 254 may include a first lower protrusion 257 inserted into the lower case 270, which will be described later.

The circumferential wall 260 of the lower tray 250 may include a first coupling protrusion 262 coupled to the lower case 210. The first coupling protrusion 262 may horizontally protrude from the first wall 260*a* of the circumferential wall 260. The first coupling protrusion 262 may be disposed on an upper portion of a side surface of the first wall 260*a*.

The circumferential wall 260 of the lower tray 250 may further include a second coupling protrusion 262*c*. The second coupling protrusion 262*c* is coupled to the lower case 210. The second coupling protrusion 262*c* may protrude from the second wall 260*a* of the circumferential wall 260. The second coupling protrusion 260*c* may be inserted into a second coupling slit 215*a* defined in the circumferential wall 214 of the lower case 210.

The second coupling protrusion 260*c* serves to prevent the end of the second wall 260*b* of the lower tray 250 from being deformed by being in contact with the upper tray 150 in a process in which the lower tray 250 is rotated in the reverse direction. The second coupling protrusion 260*c* may protrude from the second wall 260*a* in a horizontal direction. An upper end of the second coupling protrusion 260*c* may be positioned at the same height as an upper end of the second wall 260*a*.

The lower tray body 251 may further include a convex portion 251*b* in which a portion of the lower portion of the lower tray body 251 is convex upward. That is, the convex portion 251*b* may be disposed to be convex toward the inside of the ice chamber 111.

Figure 15:
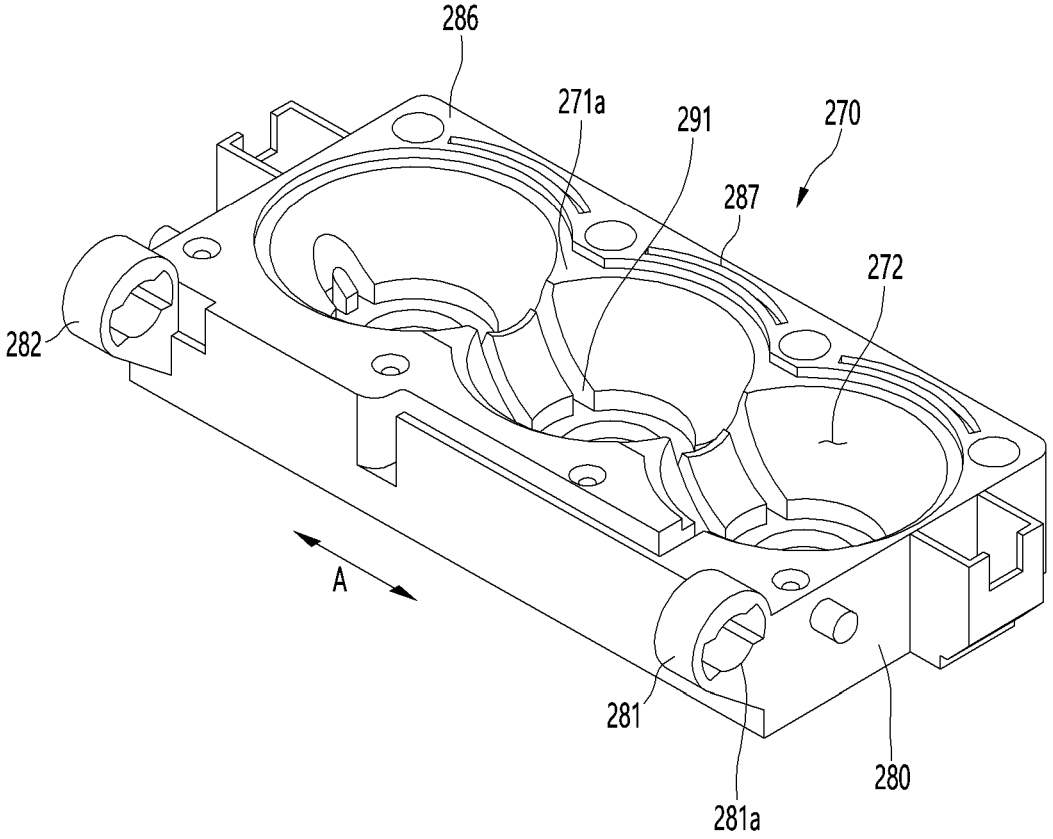
FIG. 15 is a top perspective view of a lower support according to one embodiment of the present disclosure.
Figure 16:
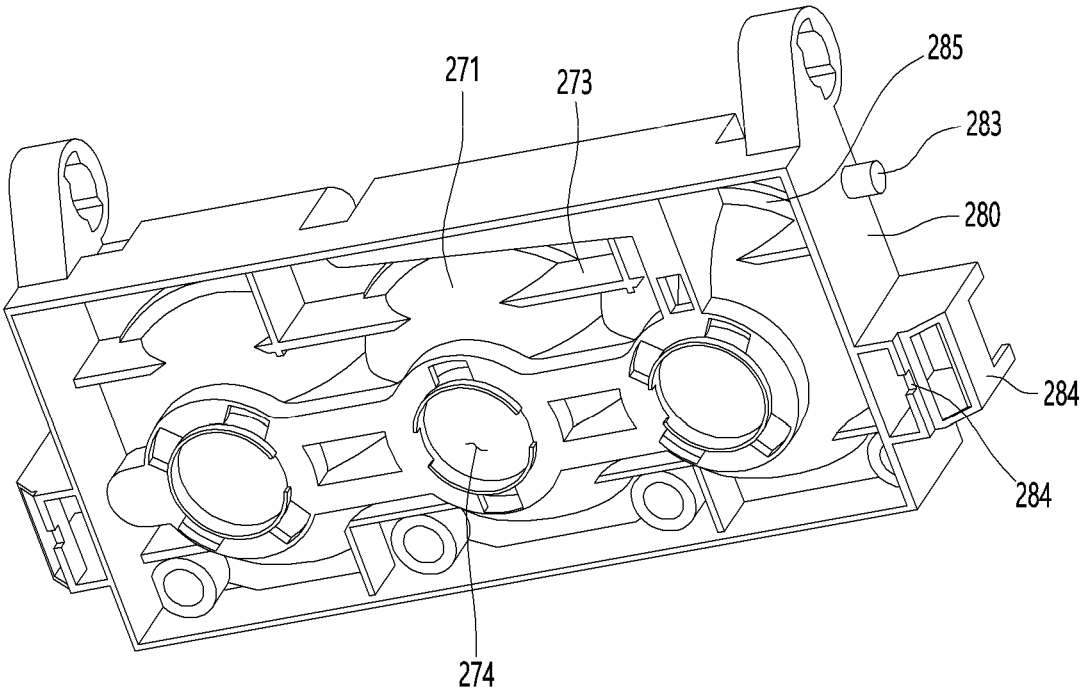
FIG. 16 is a bottom perspective view of a lower support according to one embodiment of the present disclosure.

FIG. 15 is a top perspective view of the lower support according to an embodiment, FIG. 16 is a bottom perspective view of the lower support according to an embodiment.

Referring to FIGS. 15 and 16, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

Also, the adjacent two accommodation part 272 of the three accommodation parts 272 may be connected to each other by a connection rib 273. The connection rib 273 may reinforce strength of the chamber walls 252*d*.

The lower support 270 may further include a first extension wall 285 horizontally extending from an upper end of the support body 271. The lower support 270 may further include a second extension wall 286 that is formed to be stepped with respect to the first extension wall 285 on an edge of the first extension wall 285. A top surface of the second extension wall 286 may be disposed higher than the first extension wall 285.

The first extension part 253 of the lower tray 250 may be seated on a top surface 271*a* of the support body 271, and the second extension part 285 may surround side surface of the first extension part 253 of the lower tray 250. Here, the second extension wall 286 may contact the side surface of the first extension part 253 of the lower tray 250.

The lower support 270 may further include a protrusion groove 287 accommodating the lower protrusion 257 of the lower tray 250. The protrusion groove 287 may extend in a curved shape. The protrusion groove 287 may be defined, for example, in a second extension wall 286.

The lower support 270 may further include an outer wall 280 disposed to surround the lower tray body 251 in a state of being spaced outward from the outside of the lower tray body 251. The outer wall 280 may, for example, extend downward along an edge of the second extension wall 286.

The lower support 270 may further include a plurality of hinge bodies 281 and 282 respectively connected to hinge supports 135 and 136 of the upper case 210. The plurality of hinge bodies 281 and 282 may be disposed to be spaced apart from each other in a direction of an arrow A of FIG. 15. Each of the hinge bodies 281 and 282 may further include a second hinge hole 281*a*. The shaft connection part 353 of the first link 352 may pass through the second hinge hole 281. The connection shaft 370 may be connected to the shaft connection part 353.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

Also, the lower support 270 may further include an elastic member coupling part 284 to which the elastic member 360 is coupled. The elastic member coupling part 284 may define a space in which a portion of the elastic member 360 is accommodated. Since the elastic member 360 is accommodated in the elastic member coupling part 284 to prevent the elastic member 360 from interfering with the surrounding structure. The elastic member coupling part 284 may include a hook part 284*a* on which a lower end of the elastic member 370 is hooked.

The lower supporter 270 may further include a heater accommodation groove 291 to which the lower heater 296 is coupled. The heater accommodation groove 291 may be recessed downward in the chamber accommodation part 272 of the lower tray body 251. The lower heater 296 may be referred to as a second heater.

Figure 17:
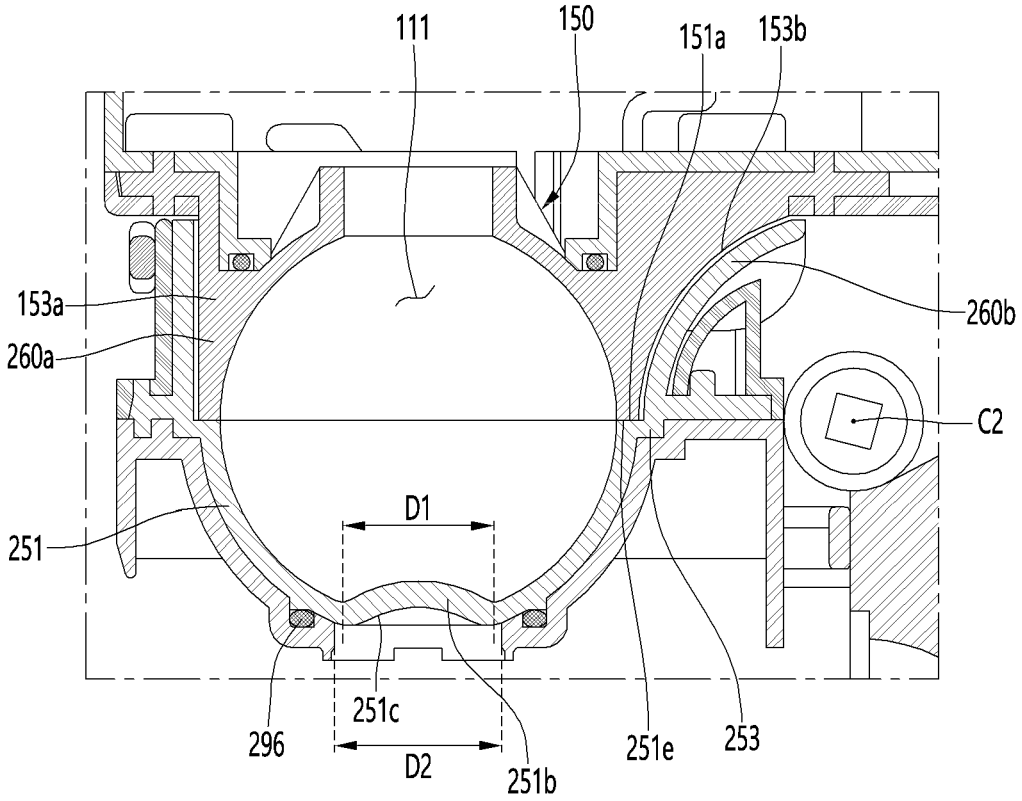
FIG. 17 is a cross-sectional view taken along line 17-17 of FIG. 3.
Figure 18:
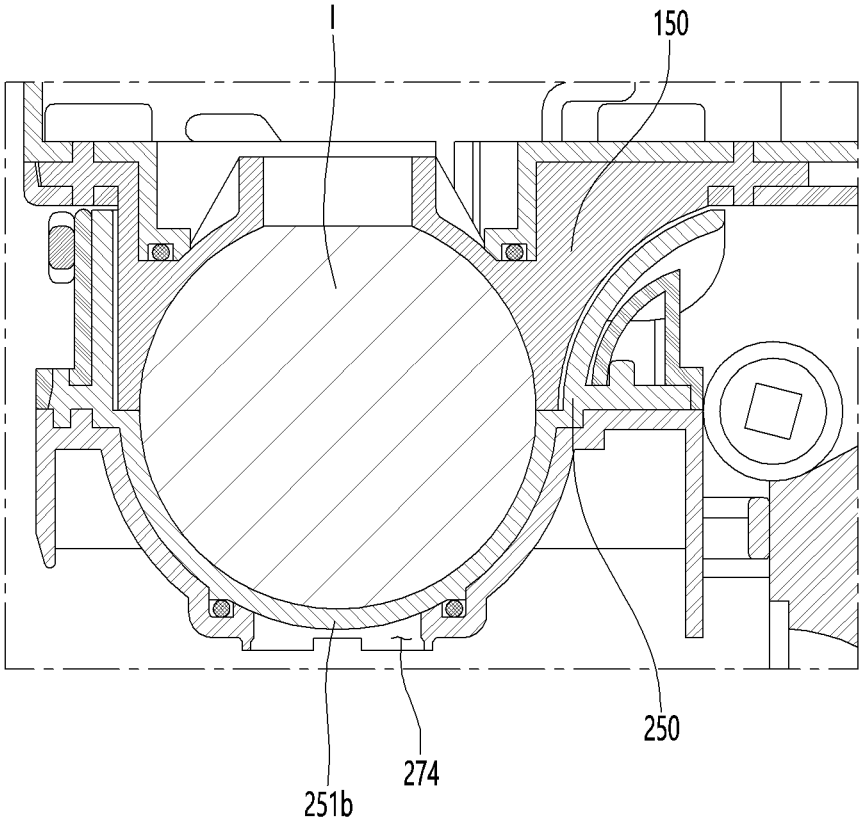
FIG. 18 is a view showing a state in which ice generation is completed in FIG. 17.

FIG. 17 is a cross-sectional view taken along line 17-17 of FIG. 3, and FIG. 18 is a view showing a state in which ice generation is completed in FIG. 17.

Referring to FIGS. 17 and 18, a lower heater 296 may be mounted on the lower support 270.

The lower heater 297 may provide the heat to the ice chamber 111 during the ice making process so that ice within the ice chamber 111 is frozen from an upper side.

Also, since lower heater 296 generates heat in the ice making process, bubbles within the ice chamber 111 may move downward during the ice making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may contact the lower tray 250 to provide heat to the lower chamber 252. The lower heater 296 may contact the lower support 270.

For example, the lower heater 296 may contact the lower tray body 251. Also, the lower heater 296 may be disposed to surround the three chamber walls 252*d* of the lower tray body 251.

The lower support 270 may further include a heater accommodation groove 291 that is recessed downward from the chamber accommodation part 272 of the lower tray body 251.

The upper tray 150 and the lower tray 250 vertically contact each other to complete the ice chamber 111.

The bottom surface 151*a* of the upper tray body 151 contacts the top surface 251*e* of the lower tray body 251. Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151. Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surfaces may not occur to prevent ice having a thin band shape along a circumference of the spherical ice from being made after the ice making is completed.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250. Here, the vertical wall 153*a* of the upper tray body 151 may be disposed to face the vertical wall 260*a* of the lower tray 250, and the curved wall 153*b* of the upper tray body 151 may be disposed to face the curved wall 260*b* of the lower tray 250.

An outer face of the chamber wall 153 of the upper tray body 151 is spaced apart from an inner face of the circumferential wall 260 of the lower tray 250. That is, a space may be defined between the outer face of the chamber wall 153 of the upper tray body 151 and the inner face of the circumferential wall 260 of the lower tray 250.

Water supplied through the water supply part 180 is accommodated in the ice chamber 111. When a relatively large amount of water than a volume of the ice chamber 111 is supplied, water that is not accommodated in the ice chamber 111 may flow into the space between the outer face of the chamber wall 153 of the upper tray body 151 and the inner face of the circumferential wall 260 of the lower tray 250. Thus, according to this embodiment, even though a relatively large amount of water than the volume of the ice chamber 111 is supplied, the water may be prevented from overflowing from the ice maker 100.

In a state where the upper surface 251*e* of the lower tray body 251 is in contact with the lower surface 151*a* of the upper tray body 151, the upper surface of the circumferential wall 260 may be positioned to be higher than the upper opening 154 or the upper chamber 152 of the upper tray 150.

The lower tray body 251 may further include a convex portion 251*b* in which a portion of the lower portion of the lower tray body 251 is convex upward. A recess 251*c* may be defined below the convex portion 251*b* so that the convex portion 251*b* has substantially the same thickness as the other portion of the lower tray body 251. In this specification, the "substantially the same" is a concept that includes completely the same shape and a shape that is not similar but there is little difference. The convex portion 251*b* may be disposed to vertically face the lower opening 274 of the lower support 270.

The lower opening 274 may be defined just below the lower chamber 252. That is, the lower opening 274 may be defined just below the convex portion 251*b*.

The convex portion 251*b* may have a diameter D less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded. If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 is not formed into a spherical form before the ice is generated. After the generation of the ice is completed, the convex portion 251*b* of the lower tray body 251 is deformed toward the lower opening 274, such that the spherical ice may be generated. In the present embodiment, the diameter D1 of the convex portion 251*b* is smaller than the diameter D2 of the lower opening 274, such that the convex portion 251*b* may be deformed and positioned inside the lower opening 274.

Figure 19:
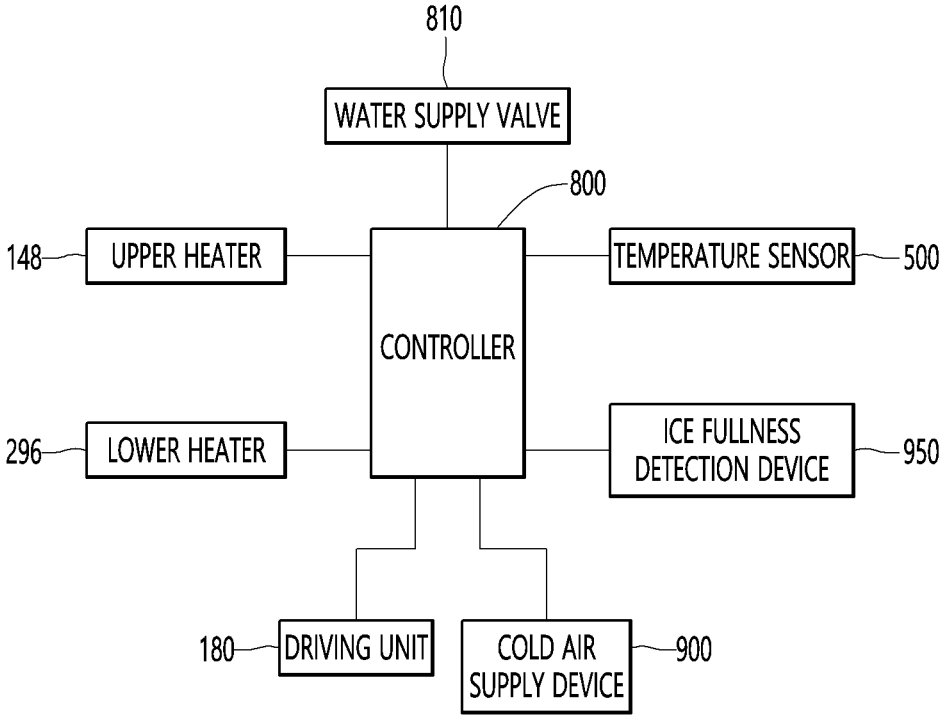
FIG. 19 is a control block diagram showing a refrigerator according to an embodiment of the present disclosure.

FIG. 19 is a control block diagram showing a refrigerator according to an embodiment of the present disclosure.

Referring to FIG. 19, the refrigerator according to the present embodiment may further include a cold air supply device 900 that operates to supply cold air to the freezing compartment 4. The cold air supply device 900 may supply cold air to the freezing compartment 32 using a refrigerant cycle.

The cold air supply device 900 may be referred to as a cold air generating device that operates to generate cold air.

For example, the cold air supply device 900 may include a compressor to compress the refrigerant. The temperature of the cold air supplied to the freezing compartment 4 may vary according to the output (or frequency) of the compressor. Alternatively, the cold air supply device 900 may include a fan for blowing air to the evaporator. The amount of cold air supplied to the freezing compartment 4 may vary according to the output (or rotational speed) of the fan. Alternatively, the cold air supply device 900 may include a refrigerant valve for controlling the amount of refrigerant flowing through the refrigerant cycle.

The amount of refrigerant flowing through the refrigerant cycle is changed by adjusting the opening degree by the refrigerant valve, and accordingly, the temperature of the cold air supplied to the freezing compartment 4 may vary. Accordingly, in this embodiment, the cold air supply device 900 may include one or more of the compressor, the fan, and the refrigerant valve.

The refrigerator of this embodiment may further include a controller 800 for controlling the cold air supply device 900.

The refrigerator may further include a water supply valve 810 for controlling the amount of water supplied through the water supply part 190.

The controller 800 may control some or all of the upper heater 148, the lower heater 296, the driving unit 180, the cold air supply device 900, and the water supply valve 810.

The controller 800 may determine whether ice making is completed based on the temperature detected by the temperature sensor 500.

The refrigerator may further include a ice fullness detection device 950 for detecting ice fullness of the ice bin 600. The ice fullness detection device 950 may include, for example, the ice fullness detection lever 700, a magnet provided in the driving unit 180, and a Hall sensor for detecting the magnet.

As another example, the ice fullness detection device 950 may include a light emitting unit and a light receiving unit provided in the ice bin 102. In this case, the ice fullness detection lever 700 may be omitted. When the light irradiated from the light emitting unit reaches the light receiving unit, it may be determined that the ice bin is not full of ice. When the light irradiated from the light emitting unit does not reach the light receiving unit, it may be determined that the ice bin is full of ice.

In this case, the light emitting unit and the light receiving unit may be provided in the ice maker. In this case, the light emitting unit and the light receiving unit may be located in the ice bin.

As described above, since the type and time of the signal output from the hall sensor for each position of the lower tray 250 are different, the controller 800 can accurately determine the current position of the lower tray 250.

When the ice fullness detection lever 700 is in the ice fullness detection position, the lower tray 250 may also be described as being in the ice fullness detection position.

Figure 20:
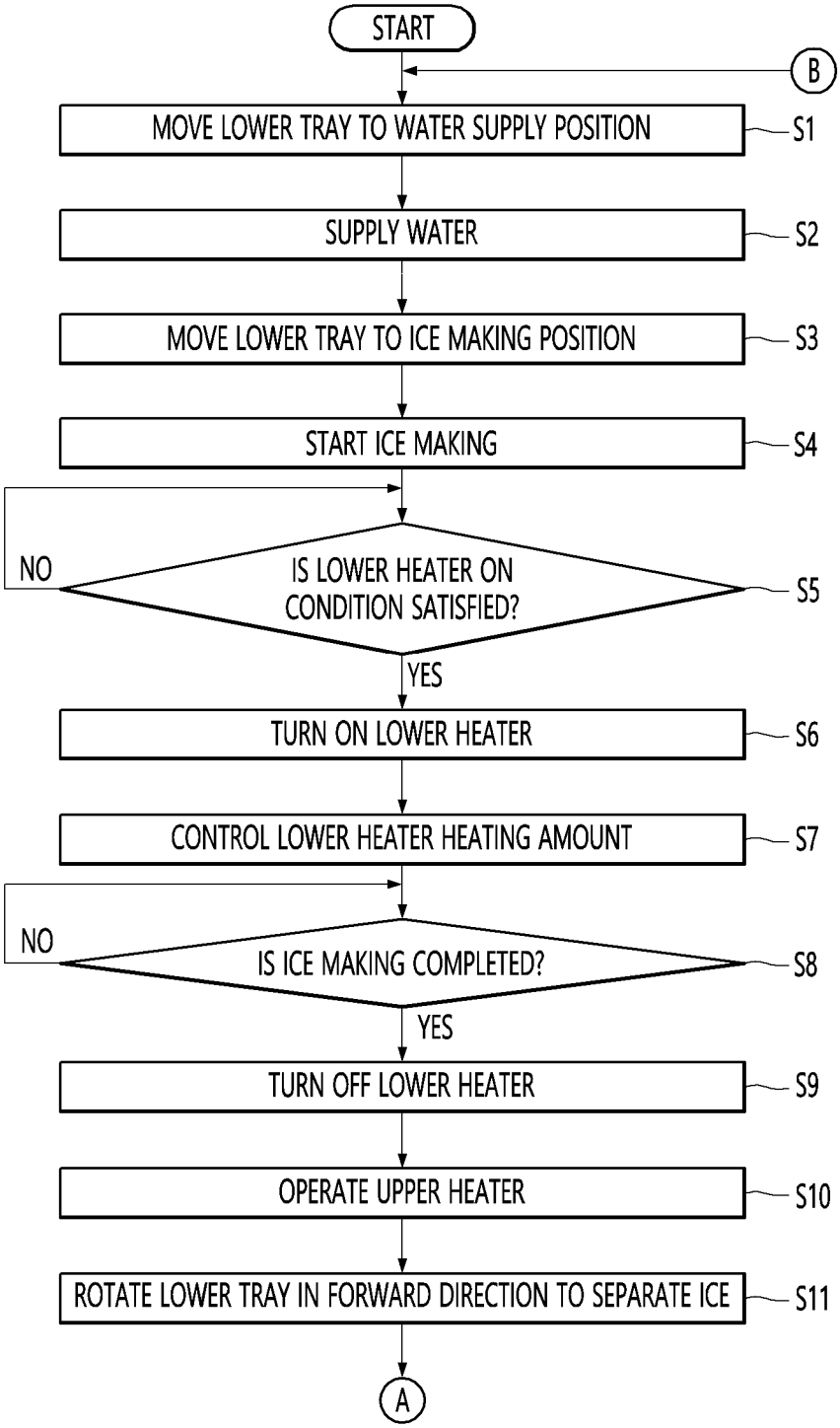
FIGS. 20 and 21 are flowcharts for explaining a process of generating ice in an ice maker according to an embodiment of the present disclosure.
Figure 21:
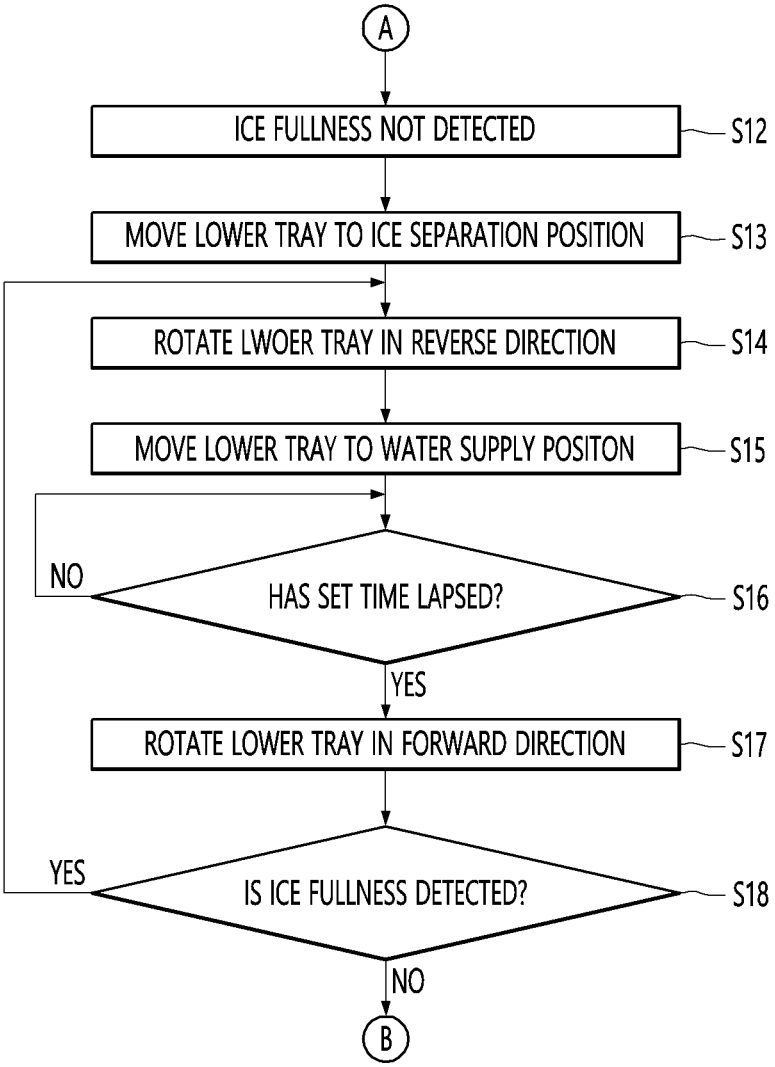

FIGS. 20 and 21 are flowcharts for explaining a process of generating ice in an ice maker according to an embodiment of the present disclosure.

Figure 22:
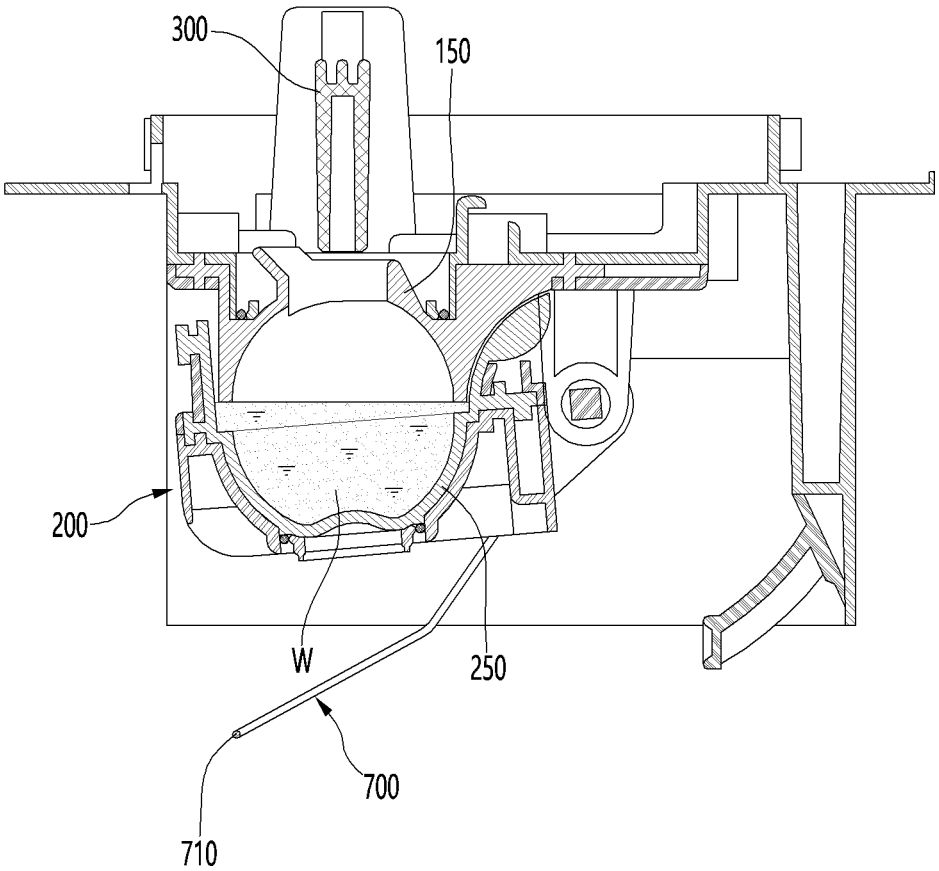
FIG. 22 is a view showing when the water supply is completed in a state where the lower tray is moved to the water supply position.
Figure 23:
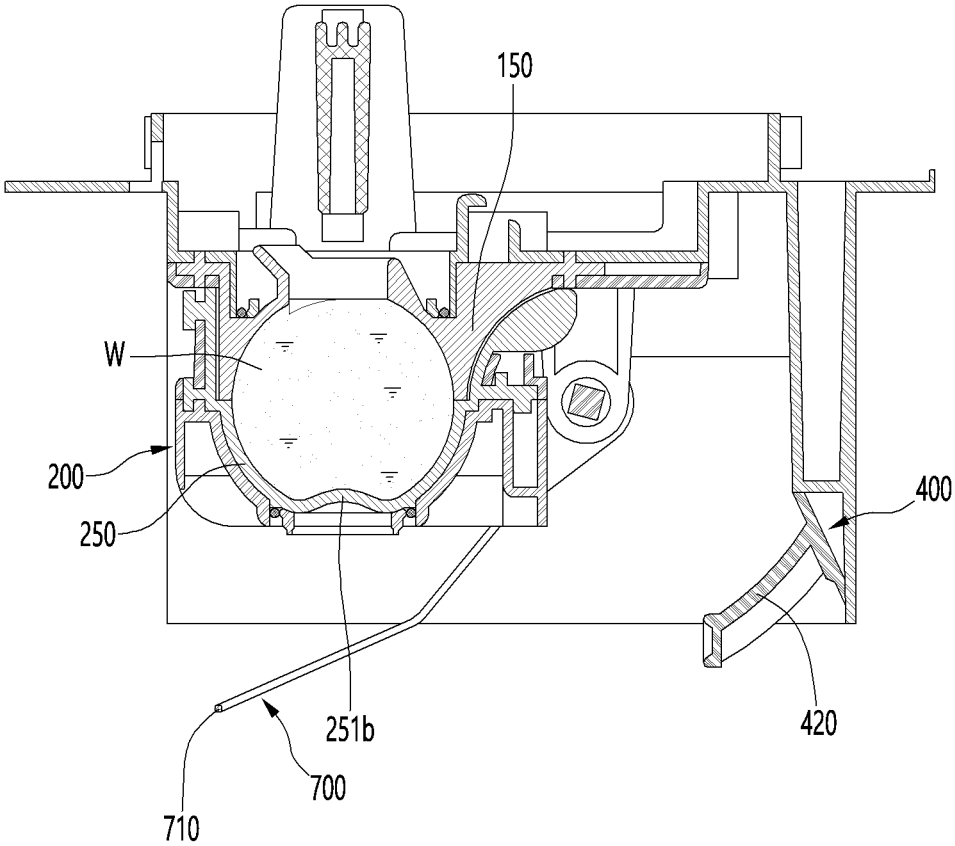
FIG. 23 is a view showing a state where the lower tray is moved to an ice making position.
Figure 24:
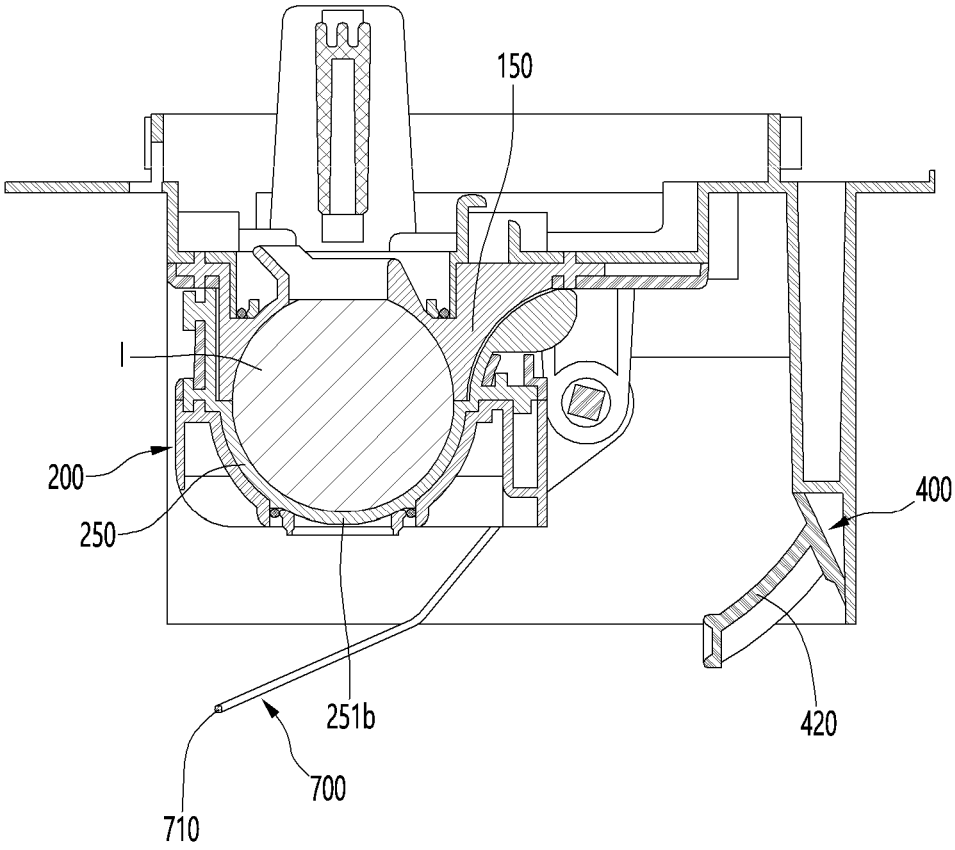
FIG. 24 is a view showing a state where ice making is completed at an ice making position.
Figure 25:
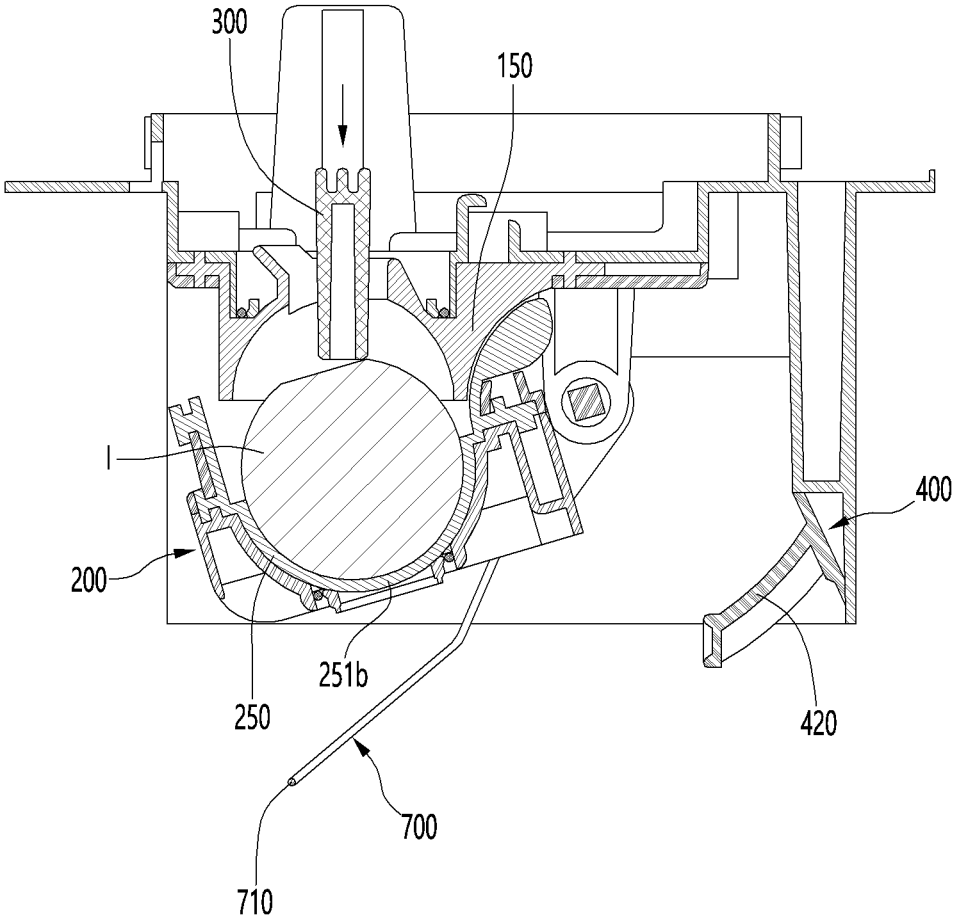
FIG. 25 is a view showing the lower tray at the beginning of the ice separation.
Figure 26:
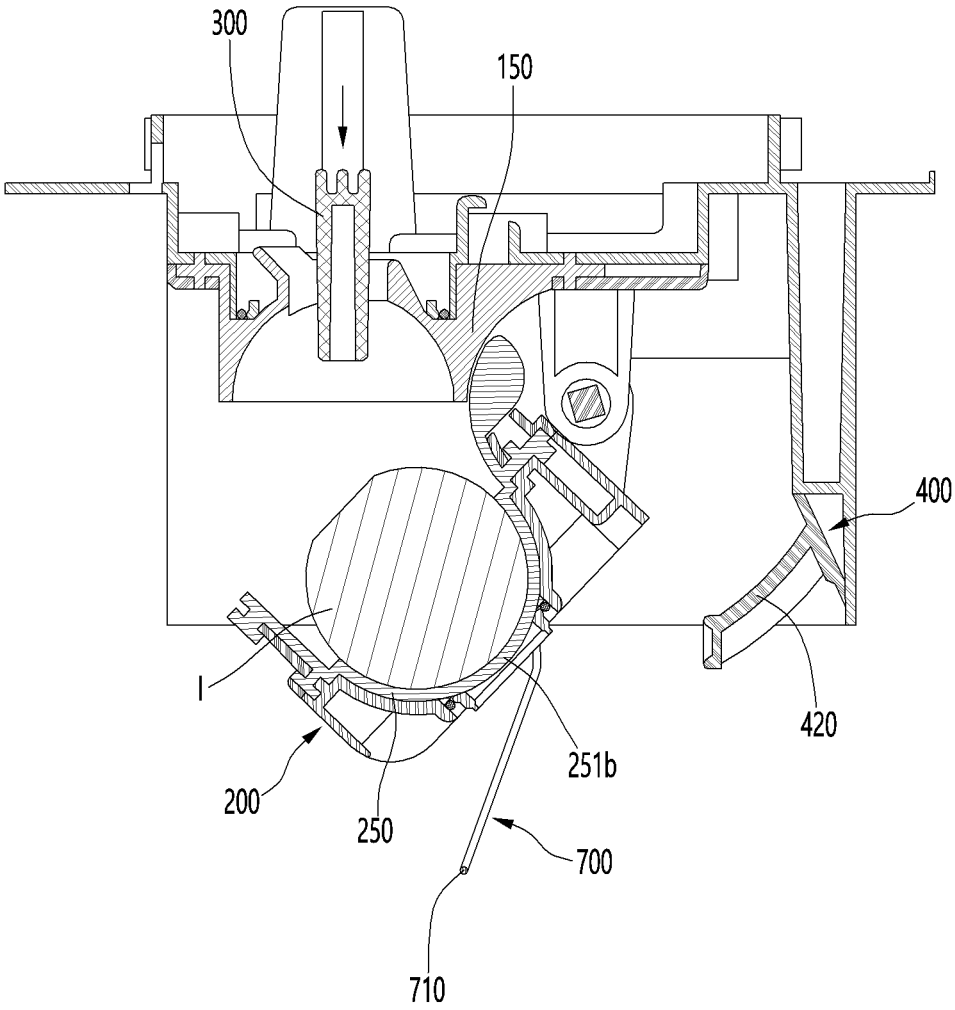
FIG. 26 is a view showing the position of the lower tray in the ice fullness detection position.
Figure 27:
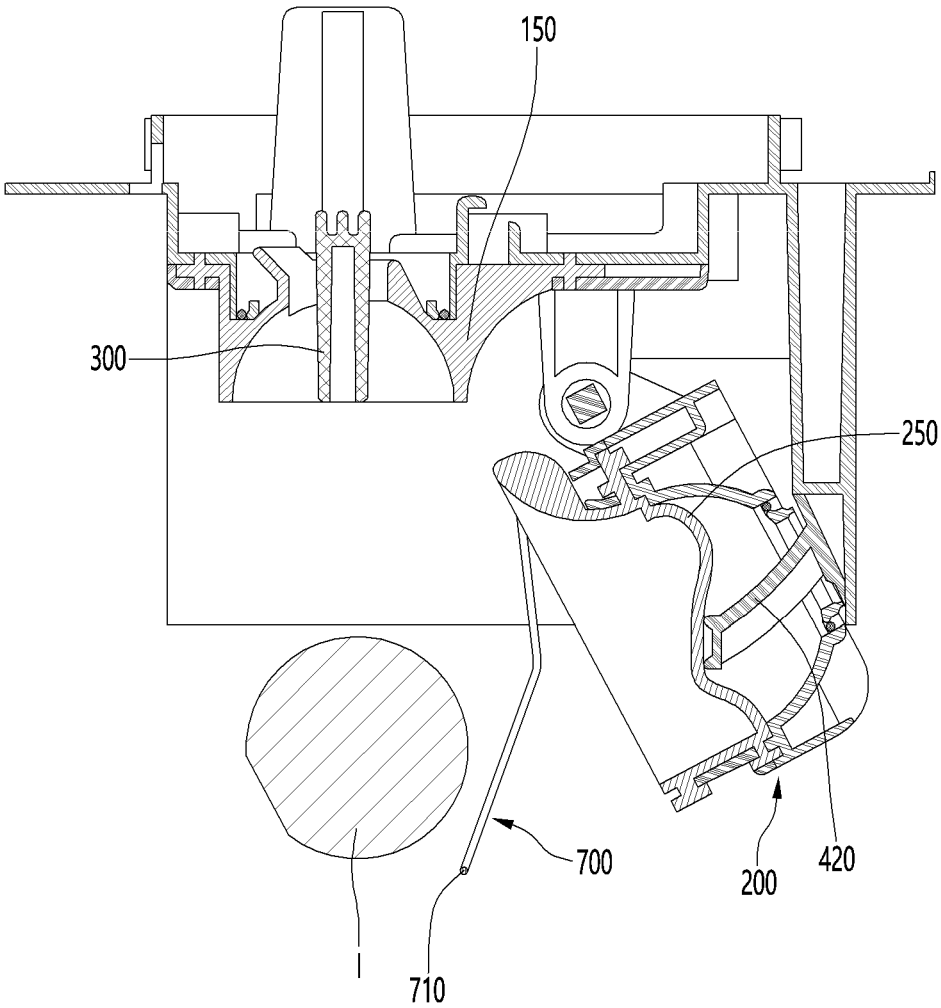
FIG. 27 is a view showing the lower tray in the ice separation position.

FIG. 22 is a view showing when the water supply is completed in a state where the lower tray is moved to the water supply position, FIG. 23 is a view showing a state where the lower tray is moved to an ice making position, FIG. 24 is a view showing a state where ice making is completed at an ice making position, FIG. 25 is a view showing the lower tray at the beginning of the ice separation, FIG. 26 is a view showing the position of the lower tray in the ice fullness detection position, and FIG. 27 is a view showing the lower tray in the ice separation position.

Referring to FIGS. 21 to 27, in order to generate ice in the ice maker 100, the controller 800 moves the lower tray 250 to the water supply position (S1).

Hereinafter, it is assumed that ice is generated in the ice maker 100 in a state where there is no ice in the ice bin 102.

In this specification, a direction in which the lower tray 250 moves from the ice making position of FIG. 23 to the ice separation position of FIG. 27 may be referred to as a forward movement (or forward rotation). On the other hand, the direction moving from the ice separation position of FIG. 27 to the water supply position of FIG. 24 may be referred to as a reverse movement (or reverse rotation).

When it is detected that the lower tray 250 has moved to the water supply position, the controller 800 stops the driving unit 180.

Water supply starts in a state where the lower tray 250 is moved to the water supply position (S2).

For water supply, the controller 800 may turn on the water supply valve 810 and turn off the water supply valve 810 when it is determined that water corresponding to a reference water supply amount is supplied. For example, in the process of supplying water, when a pulse is output from a flow sensor (not shown) and the output pulse reaches a reference pulse, it may be determined that the amount of water supply is supplied.

After the water supply is completed, the controller 810 controls the driving unit 180 to move the lower tray 250 to the ice making position (S3). For example, the controller 800 may control the driving unit 180 to move the lower tray 250 in the reverse direction from the water supply position.

When the lower tray 250 is moved in the reverse direction, the upper surface 251*e* of the lower tray 250 comes closer to the lower surface 151*a* of the upper tray 150. Then, water between the upper surface 251*e* of the lower tray 250 and the lower surface 151*a* of the upper tray 150 is divided and distributed into the plurality of lower chambers 252. When the upper surface 251*e* of the lower tray 250 and the lower surface 151*a* of the upper tray 150 are completely in close contact with each other, the upper chamber 152 is filled with water.

The movement of the ice making position of the lower tray 250 is detected by a sensor, and when it is detected that the lower tray 250 is moved to the ice making position, the controller 800 stops the driving unit 180.

Ice making starts in a state where the lower tray 250 is moved to the ice making position (S4). For example, when the lower tray 250 reaches the ice making position, ice making may start. Alternatively, when the lower tray 250 reaches the ice making position and the water supply time elapses for a set time, ice making may start.

When ice making starts, the controller 800 may control the cold air supply device 900 to supply cold air to the ice chamber 111.

After the ice making starts, the controller 800 may determine whether the ON condition of the lower heater 296 is satisfied (S5).

For example, when the temperature detected by the temperature sensor 500 reaches the ON reference temperature, the controller 800 may determine that the ON condition of the lower heater 296 is satisfied. The ON reference temperature may be a temperature for determining that water has started to freeze at the uppermost side (upper opening side) of the ice chamber 111.

When a portion of water freezes in the ice chamber 111, the temperature of the ice in the ice chamber 111 is below zero. The temperature of the upper tray 150 may be higher than the temperature of the ice in the ice chamber 111. Of course, although water is present in the ice chamber 111, the temperature detected by the temperature sensor 500 may be below zero after ice starts to be generated in the ice chamber 111. Accordingly, in order to determine that ice has started to be generated in the ice chamber 111 based on the temperature detected by the temperature sensor 500, the ON reference temperature may be set to a temperature below zero.

As described above, when the lower heater 296 is turned on (S6), heat from the lower heater 296 is transferred into the ice chamber 111. The controller 800 may control the amount of heating of the lower heater 296 in a state where the lower heater 296 is turned on (S7).

When ice making is performed in a state where the lower heater 296 is turned on, ice is generated from the uppermost side in the ice chamber 111. In the present embodiment, the mass (or volume) of water per unit height in the ice chamber 111 may be the same or different according to the shape of the ice chamber 111. For example, when the ice chamber 111 is a rectangular parallelepiped, the mass (or volume) of water per unit height in the ice chamber 111 is the same. On the other hand, in a case where the ice chamber 111 has a shape such as a sphere, an inverted triangle, and a crescent shape, the mass (or volume) of water per unit height is different.

If it is assumed that the temperature and amount of cold air supplied to the freezing compartment 4 are constant, if the output of the lower heater 296 is the same, since the mass of water per unit height in the ice chamber 111 is different, the rate of ice formation per unit height may be different.

For example, in a case where the mass per unit height of water is small, the formation rate of ice is fast, whereas in a case where the mass per unit height of water is large, the formation rate of ice is slow.

As a result, the speed at which ice is generated per unit height of water is not constant, so that the transparency of ice may vary according to unit height. In particular, in a case where the rate of generation of ice is high, the bubbles may not move from the ice to the water side, so that the ice contains the bubbles and thus the transparency may be low.

Accordingly, in the present embodiment, it is possible to control the amount of heating (for example, output) of the lower heater 296 to vary according to the mass per unit height of water in the ice chamber 111 (S7).

As in this embodiment, when the ice chamber 111 is formed in a spherical shape, for example, the mass of water per unit height in the ice chamber 111 increases from the upper side to the lower side, becomes a maximum, and then decreases again.

Accordingly, after the lower heater 296 is turned on, the output of the lower heater 296 may be reduced in stages to become the minimum output. Then, the output of the lower heater 296 may be increased in stages according to a decrease in the mass per unit height of water. Accordingly, since ice is generated from the upper side in the ice chamber 111, the bubbles in the ice chamber 111 move downward.

In a process in which ice is generated from the top to the bottom in the ice chamber 111, the ice comes into contact with the upper surface of the block part 251*b* of the lower tray 250. In this state, if ice is continuously generated, the block part 251*b* is pressed and deformed as shown in FIG. 24, and when ice making is completed, spherical ice may be generated.

The controller 800 may determine whether the ice making is completed based on the temperature detected by the temperature sensor 500 (S8).

When it is determined that ice making is completed, the controller 800 may turn off the lower heater 296 (S9).

For example, when the temperature detected by the temperature sensor 500 reaches an OFF reference temperature, the controller 800 may determine that ice making is complete and turn off the lower heater 296.

When the ice making is completed, the controller 800 operates at least one of the upper heater 148 and the lower heater 296 to separate the ice (S10).

When at least one of the upper heater 148 and the lower heater 296 is turned on, the heat of the heaters 148 and 296 is transferred to at least one of the upper tray 150 and the lower tray 250 and thus ice may be separated from the surface (inner surface) of at least one of the upper tray 150 and the lower tray 250.

In addition, the heat of the heaters 148 and 296 is transferred to the contact surface of the upper tray 150 and the lower tray 250, so that the lower surface 151*a* of the upper tray 150 and the upper surface 251*e* of the lower tray 250 is in a separable state.

When one or more of the upper heater 148 and the lower heater 296 is operated for a set time or when the temperature detected by the temperature sensor 500 is equal to or greater than the set temperature, the controller 800 can turn off the turned on heater 148 and 296.

Although not limited, the set temperature may be set to the temperature of above zero.

For ice separation, the controller 800 operates the driving unit 180 so that the lower tray 250 moves in the forward direction (S11).

When the lower tray 250 is moved in the forward direction as shown in FIG. 25, the lower tray 250 is spaced apart from the upper tray 150.

The moving force of the lower tray 250 may be transmitted to the upper ejector 300 by the connection unit 350. Then, the upper ejector 300 descends along the guide slot 183, and thus the upper ejecting pin 320 passes through the upper opening 154 to press the ice in the ice chamber 111.

In a process in which the lower tray 250 is moved from the ice making position of FIG. 23 to the ice fullness detection position of FIG. 26, whether the ice fullness of the ice bin 102 may be detected by the ice fullness detection device 950.

As described above, since it was assumed that there is no ice in the ice bin 102, ice fullness will not be detected in the ice bin 102 (S12).

When the ice bin 102 is not full of ice, the ice fullness detection lever 700 may also move to the ice fullness detection position in a process in which the lower tray 250 is rotated.

In a state where the ice fullness detection lever 700 is moved to the ice fullness detection position, the detection body 700 is positioned below the lower assembly 200. For example, the ice fullness detection device may detect whether the lower tray 250 is full of ice when the lower tray 250 is positioned at the ice fullness detection position.

In the ice separation process, if it is determined that ice fullness is not detected in the ice bin 102, the controller 800 controls the driving unit 180 so that the lower tray 250 is rotated to the ice separation position as shown in FIG. 27 (S13).

In a process in which the lower tray 250 is moved to the ice separation position, the lower tray 250 comes into contact with the lower ejecting pin 420.

When the lower tray 250 is continuously rotated in the forward direction in a state where the lower tray 250 is in contact with the lower ejecting pin 420, the lower ejecting pin 420 presses the lower tray 250, the lower tray 20 is deformed, and the pressing force of the lower ejecting pin 420 is transferred to the ice, so that the ice can be separated from the surface of the lower tray 250. The ice separated from the surface of the lower tray 250 may be dropped downward and be stored in the ice bin 102.

During the ice separation process, at least a portion of the lower tray 250 that has been in contact with the lower supporter 270 is spaced apart (separated) from the lower supporter 270, and accordingly, the lower heater 296 is also spaced apart (separated) from the lower tray 250.

After the ice is separated from the lower tray 250, the lower tray 200 is rotated in the reverse direction by the driving unit 180 again (S14).

The controller 800 may control the driving unit 180 so that the lower tray 250 is moved to the water supply position after the ice separation is completed (S15).

After the lower tray 250 moves to the water supply position, the controller 800 determines whether a set time has elapsed (S16), and when the set time has elapsed, the controller 800 can control the driving part 180 so that the lower tray 250 is rotated in the forward direction.

The controller 800 may determine again whether ice fullness of the ice bin 102 is detected by the ice fullness detecting device 950 in a process in which the lower tray 250 is rotated in the forward direction (S18).

As a result of determination in step S18, when it is determined that ice fullness of the ice bin 102 is not detected by the ice fullness detection device 950, the controller 800 causes the lower tray 250 to move to the water supply position (S1), and then can start water supply (S2).

On the other hand, as a result of determination in step S18, if it is determined that ice fullness of the ice bin 102 is detected by the ice fullness detection device 950, the controller 800 rotates the lower tray 250 in the reverse direction to move the lower tray to the water supply position and then waits for a set time (S14 to S16).

Then, by rotating the lower tray 250 in the forward direction again, it is possible to determine again whether ice fullness of the ice bin 102 is detected by the ice fullness detecting device 950.

In the present embodiment, after ice separation is performed since ice fullness is not detected in the ice separation process after completion of ice making, it may be determined whether ice fullness is detected by the ice dropped by the ice separation.

It is described, as an assumption, a case where, after ice making is completed, since ice fullness is not detected during the ice separation process, after ice separation is performed, the ice bin is full of ice due to ice dropped by the ice separation.

As described above, it may be assumed that the ice bin 102 is filled with ice dropped by the ice separation, and in this state, the lower tray 250 is moved to the water supply position and then water supply starts. In this case, when the ice making is completed, ice separation is attempted.

In a state where ice fullness of the ice bin 102 is continuously maintained, ice fullness of the ice bin 102 may be detected during the ice separation process of the lower tray 250. When ice fullness of the ice bin 102 is detected, the lower tray 250 does not perform ice separation and waits at a specific position.

As described above, after ice making is completed in the lower tray 250, in a state where ice separation is not performed due to ice fullness of the ice bin 102, ice can melt from the ice chamber 111 due to an abnormal situation such as a power outage or power supply cutoff.

If the lower tray 250 waits the ice separation at the ice fullness detection position as an example, there may be a problem in that ice melted from the lower tray 250 is dropped into the ice bin 102.

In a case where the abnormal situation is released, the water melted in the ice chamber 111 may be changed back to ice.

However, since ice fullness has already been detected before, the lower heater 296 does not operate, so that the ice generated in the ice chamber 111 is not transparent and has a non-spherical shape.

In a case where the opaque and non-spherical ice is dropped onto the ice bin 102 by ice separation, the user uses the opaque and non-spherical ice, which may cause emotional dissatisfaction with the user.

However, as in the present disclosure, ice fullness is not detected during the ice separation process, but ice fullness is detected again after the ice separation is completed, and if ice fullness of the ice bin is detected by the dropped ice, in the case of waiting for ice making until ice fullness is not detected in the ice bin again, the problem described above can be solved.

As a result, the ice maker 100 can generate ice only when ice fullness is not detected in the ice bin 102. When ice fullness is detected in the ice bin 102 again, the ice fullness detecting device 950 may repeatedly perform ice fullness detection at a predetermined cycle.

In addition, in the present embodiment, since the lower tray 250 moves to the ice fullness detection position after the lower tray 250 moves from the ice separation position to the water supply position in order to detect ice fullness again, the rotation of the lower tray 250 in the forward direction can be smoothed.

That is, in the water supply position, since at least a portion of the lower surface 151*a* of the upper tray 150 is spaced apart from the upper surface 251*e* of the lower tray 250, until the lower tray 250 moves to the ice fullness detection position, during the standby process, freezing between the upper tray 150 and the lower tray 250 is minimized, so that the lower tray 250 can be rotated smoothly in the forward direction.

As another embodiment, as described above, although it has been mentioned that the set time for detecting ice fullness again after the ice separation is completed and the waiting time after detecting ice fullness in step S18 are the same, it is also possible that the set time and the waiting time are different.

For example, after ice fullness of the ice bin 102 is not detected and the lower tray 250 is moved to the ice separation position (S13) and rotated to the water supply position in the reverse direction (S15), when the first set time has elapsed, the lower tray 250 may move in the forward direction again. In addition, when ice fullness is detected in a process in which the lower tray 250 moves in the forward direction again, the lower tray 250 is rotated back to the water supply position and then can wait for a second set time greater than the first set time.

As another embodiment, if ice fullness of the ice bin 102 is not detected after determining the ice fullness of the ice bin 102 again in step S18, the lower tray 250 does not move directly to the water supply position and can move to the water supply position after moving to the ice separation position.

Although the ice separation process is performed in step S13, in a case where ice is not actually separated from the lower tray 250, water may be supplied to the ice chamber 111 in the presence of ice. In the present disclosure, in order to prevent such a case, the lower tray 250 may be moved to the water supply position after being moved to the ice separation position once more.

The invention claimed is:

1. A method for controlling a refrigerator including a first tray configured to form a portion of an ice chamber, a second tray configured to form another portion of the ice chamber, a driving unit configured to move the second tray, an ice bin configured to store ice generated in the ice chamber, and an ice-fullness detection device configured to detect an ice fullness of the ice bin, the method comprising:

moving the second tray to a water supply position in a first direction;

performing water supply to the ice chamber based on moving the second tray to the water supply position;

based on completion of the water supply, moving the second tray to an ice making position in the first direction;

performing ice making after the second tray is moved to the ice making position;

determining the ice fullness of the ice bin while moving the second tray toward an ice separation position in a second direction opposite to the first direction after completion of the ice making;

based on the ice fullness of the ice bin not being detected while moving the second tray toward the ice separation position in the second direction, moving the second tray to the ice separation position to thereby separate the ice from the ice chamber;

moving the second tray to the water supply position in the first direction after ice separation is completed; and before determining to supply water to the ice chamber the water supply position, moving the second tray in the second direction from the water supply position toward the ice separation position to thereby determine again the ice fullness of the ice bin.

2. The method of claim 1, wherein the ice-fullness detection device is configured to detect the ice fullness of the ice bin based on the second tray being positioned at an ice fullness detection position between the water supply position and the ice separation position.

3. The method of claim 1, further comprising:

before moving the second tray toward the ice separation position in the second direction, waiting for a first set time at the water supply position.

4. The method of claim 3, wherein the ice-fullness detection device is configured to detect the ice fullness of the ice bin while the second tray is moved toward the ice separation position.

5. The method of claim 1, further comprising:

based on the ice fullness of the ice bin not being detected as a result of determining again the ice fullness of the ice bin, rotating the second tray to the water supply position; and supplying water to the ice chamber.

6. The method of claim 5, further comprising:

after determining again the ice fullness of the ice bin, moving the second tray from an ice fullness detection position to the ice separation position before moving the second tray to the water supply position.

7. The method of claim 5, further comprising:

based on the ice fullness of the ice bin not being detected as a result of determining again the ice fullness of the ice bin, rotating the second tray to the water supply position;

waiting for a second set time with the second tray being at the water supply position; and rotating the second tray toward the ice separation position in the second direction.

8. The method of claim 7, wherein the ice-fullness detection device is configured to detect the ice fullness of the ice bin while the second tray is moved in the second direction toward the ice separation position.

9. A refrigerator comprising:

a storage space configured to store food;

a first tray configured to form a portion of an ice chamber for generating ice by cold air for cooling the storage space;

a second tray configured to form another portion of the ice chamber and to move relative to the first tray;

a driving unit configured to move the second tray;

an ice bin configured to store the ice separated from the ice chamber;

an ice fullness detection device configured to detect an ice fullness of the ice bin; and a controller configured to control the driving unit, wherein the controller is configured to:

move the second tray to a water supply position in a first direction, based on completion of water supply to the ice chamber at the water supply position, move the second tray to an ice making position in the first direction, after completion of ice making, determine the ice fullness of the ice bin while moving the second tray toward an ice separation position in a second direction opposite to the first direction, based on the ice fullness of the ice bin not being detected while moving the second tray toward the ice separation position in the second direction, move the second tray to the ice separation position to thereby separate the ice from the ice chamber, move the second tray to the water supply position in the first direction after ice separation is completed, and move the second tray in the second direction from the water supply position toward the ice separation position to thereby determine again the ice fullness of the ice bin before water is supplied to the ice chamber.

10. The refrigerator of claim 9, wherein the ice fullness detection device is configured to detect the ice fullness of the ice bin while the second tray moves from the water supply position to the ice separation position.

11. The refrigerator of claim 10, wherein the controller is configured to, based on the ice fullness of the ice bin not being detected as a result of determining again the ice fullness of the ice bin, move the second tray to the water supply position in the first direction and then start to supply water to the ice chamber.

12. The refrigerator of claim 11, wherein the controller is configured to control the driving unit to move the second tray toward the ice separation position before the second tray is moved to the water supply position.

13. The refrigerator of claim 10, wherein the controller is configured to, based on the ice fullness of the ice bin being detected as a result of determining again the ice fullness of the ice bin, move the second tray in the first direction to move the second tray to the water supply position and then determine again whether the ice fullness of the ice bin is detected by the ice fullness detection device.

14. The refrigerator of claim 10, wherein the ice fullness detection device includes an ice fullness detection lever configured to move together with the second tray based on the second tray moving from the ice making position to an ice fullness detection position.

15. The refrigerator of claim 14, wherein the ice fullness detection position is disposed between the water supply position and the ice separation position.

* * * * *